US010480230B2

(12) United States Patent
Brun

(10) Patent No.: US 10,480,230 B2
(45) Date of Patent: Nov. 19, 2019

(54) HINGE FOR REVOLVING SHUTTERS, ESPECIALLY OF SHOWER BOX

(71) Applicant: Mypro Research S.R.L., Thiene (IT)

(72) Inventor: Giancarlo Brun, Thiene (IT)

(73) Assignee: Mypro Research S.R.L., Thiene (IT)

( * ) Notice: Subject to any disclaimer, the term of this patent is extended or adjusted under 35 U.S.C. 154(b) by 0 days.

(21) Appl. No.: 15/762,808

(22) PCT Filed: Sep. 21, 2016

(86) PCT No.: PCT/IB2016/055632
§ 371 (c)(1),
(2) Date: Mar. 23, 2018

(87) PCT Pub. No.: WO2017/051328
PCT Pub. Date: Mar. 30, 2017

(65) Prior Publication Data

US 2018/0298658 A1 Oct. 18, 2018

(30) Foreign Application Priority Data

Sep. 24, 2015 (IT) ..... 102015054762

(51) Int. Cl.
*E05D 5/02* (2006.01)
*E05D 11/10* (2006.01)
(Continued)

(52) U.S. Cl.
CPC ..... *E05D 11/1028* (2013.01); *E05D 3/02* (2013.01); *E05D 3/12* (2013.01); *E05D 5/0246* (2013.01);
(Continued)

(58) Field of Classification Search
CPC ..... E05D 5/0246; E05D 2005/0261; E05D 2005/0269; E05D 7/081; E05D 7/08;
(Continued)

(56) References Cited

U.S. PATENT DOCUMENTS 6,092,263 A * 7/2000 Boue ..... E05D 3/12 16/286
6,704,966 B1 * 3/2004 Kao ..... E05D 5/0246 16/252
(Continued)

FOREIGN PATENT DOCUMENTS

DE 102010041895 A1 * 12/2011 ..... E05D 11/1007
EP 2055878 5/2009
(Continued)

OTHER PUBLICATIONS

International Search Report and Written Opinion dated Jan. 23, 2017 for corresponding PCT patent application No. PCT/IB2016/055632.

*Primary Examiner* — Chuck Y Mah
(74) *Attorney, Agent, or Firm* — Abelman, Frayne & Schwab

(57) ABSTRACT

An improved hinge (1; 100; 150; 200; 250; 300) for revolving shutters (A), especially of shower boxes, comprising a structural assembly which includes a strike block (2; 201) defining a substantially vertical main axis (Y) and suitable to be made integral with a fixed or bearing auxiliary structure (A'), a pair of shaped flanges (3, 4; 103, 104; 203, 204; 203, 204) opposite, facing and coupled each other through fastening means (5) in such a way as to define a side recess (6) in which the strike block is substantially housed (2; 201), a side groove (7) which communicates with the outside and develops for at least part of the perimeter of the shaped flanges (3, 4; 103, 104; 203, 204; 253, 254) and is suitable to receive a peripheral portion of a revolving shutter (A) of a shower box, and an inner seat (8) hidden from view in which rotation means (9) are stably housed defining an auxiliary axis (Y') parallel to the main axis (Y) of the strike block (2; 201) and cooperating, on one hand, with the strike block (2; 201) itself in such a way as to define a first
(Continued)

operative position, in which the revolving shutter (A) closes, remaining stable in position, a room of the shower box, and at least one second operative position, in which the rotating shutter (A), as a result of rotation around the main axis (Y) imparted by a user, opens fully, remaining stable in position, the room of the shower box, and, on the other side, with elastic means (10) suitable to retain the rotation means (9) stably against the strike block (2; 201) at each of aforesaid operative positions. In particular, the elastic means (10) comprise an elastically yielding laminar body (11) shaped in such a way as to substantially embed in its own overall encumbrance the rotation means (9) which include a single idle roller (12; 156) extending for the entire height (H), defined parallel to said main axis (Y), of a head portion (13) of the strike block (2; 201), opposite to the base portion (14) associated with the fixed or bearing auxiliary structure (A').

24 Claims, 19 Drawing Sheets

(51) Int. Cl.

| | |
|---|---|
| ***E05D 3/12*** | (2006.01) |
| ***E05D 5/04*** | (2006.01) |
| ***E05D 3/02*** | (2006.01) |
| ***E05D 5/12*** | (2006.01) |
| ***E05D 5/14*** | (2006.01) |
| ***E05D 7/04*** | (2006.01) |
| ***E05D 11/02*** | (2006.01) |

(52) U.S. Cl.
CPC ..... *E05D 5/04* (2013.01); *E05D 5/12* (2013.01); *E05D 5/14* (2013.01); *E05D 7/0415* (2013.01); *E05D 11/02* (2013.01); *E05D 11/105* (2013.01); *E05D 11/1064* (2013.01); *E05D 2005/0269* (2013.01); *E05D 2011/1092* (2013.01); *E05Y 2201/48* (2013.01); *E05Y 2900/114* (2013.01)

(58) Field of Classification Search
CPC . E05D 11/1028; E05D 11/1035; E05D 11/02; E05D 11/105; E05D 11/1064; E05D 3/02; E05D 5/04; E05D 5/12; E05D 5/14; E05D 7/0415; E05D 2011/1092; E05D 3/12; E05Y 2900/114; E05Y 2600/502; E05Y 2600/60; E05Y 2201/48; E05F 11/385; E06B 3/54; A47K 3/362; A47K 2003/367; A47F 3/12; A47F 3/125; Y10T 16/534; Y10T 15/5326; Y10T 15/554
See application file for complete search history.

(56) References Cited

U.S. PATENT DOCUMENTS

| | | | | |
|---|---|---|---|---|
| 6,766,561 | B1 * | 7/2004 | Cheng | E05D 5/0246 16/235 |
| 2004/0206007 | A1 | 10/2004 | Chiang | |
| 2006/0207060 | A1 * | 9/2006 | Cheng | E05D 5/0246 16/252 |
| 2009/0106937 | A1 * | 4/2009 | Bai | E05D 11/105 16/252 |
| 2014/0265804 | A1 * | 9/2014 | Wilson | F25D 23/02 312/405 |
| 2016/0060930 | A1 * | 3/2016 | Bacchetti | E05D 5/06 16/241 |

FOREIGN PATENT DOCUMENTS

| | | | | |
|---|---|---|---|---|
| EP | 2333212 | B1 * | 8/2014 | E05D 5/0246 |
| WO | 97/43511 | | 11/1997 | |
| WO | 2013/171715 | | 11/2013 | |

* cited by examiner

FIG.32
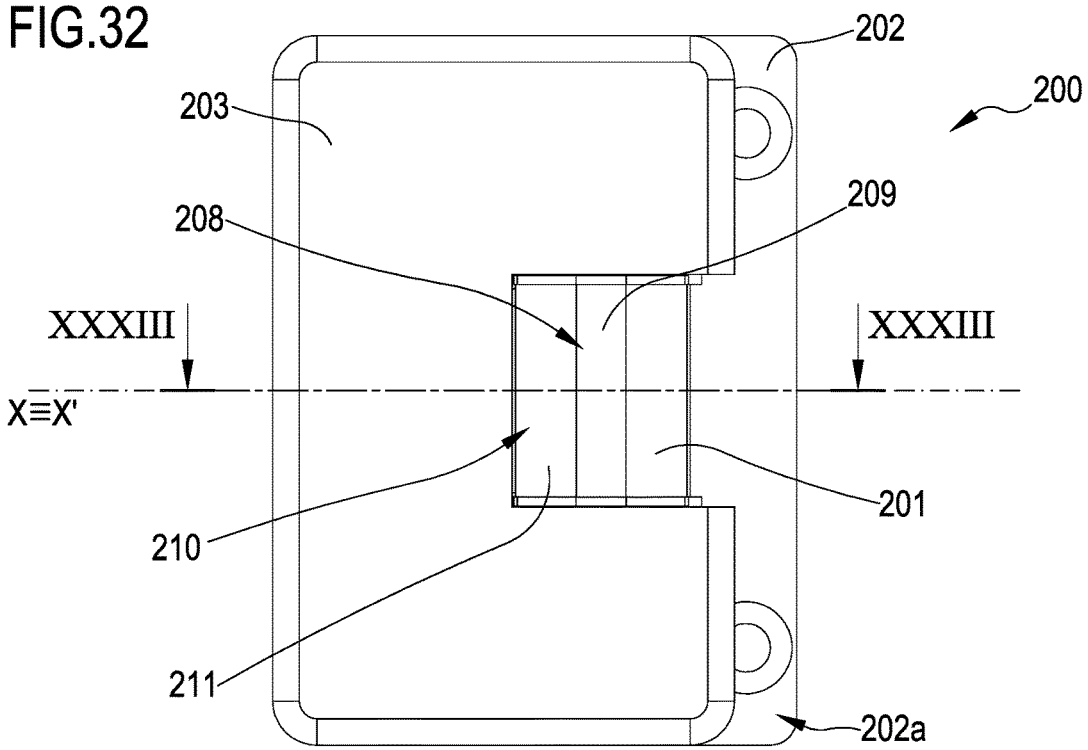
FIG.33
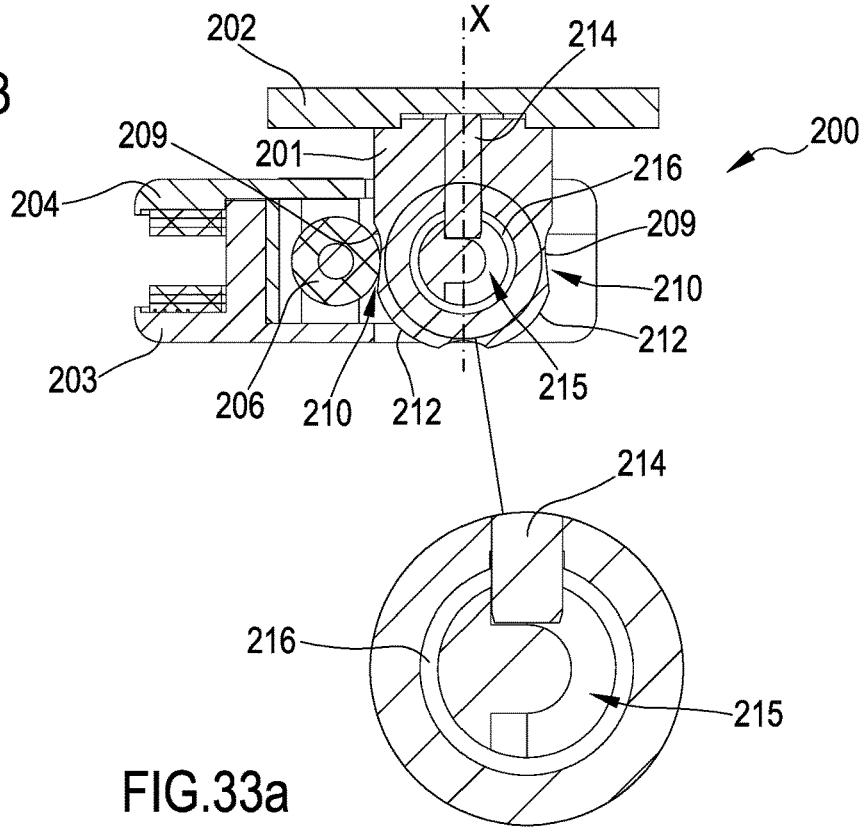
FIG.33a

FIG.34
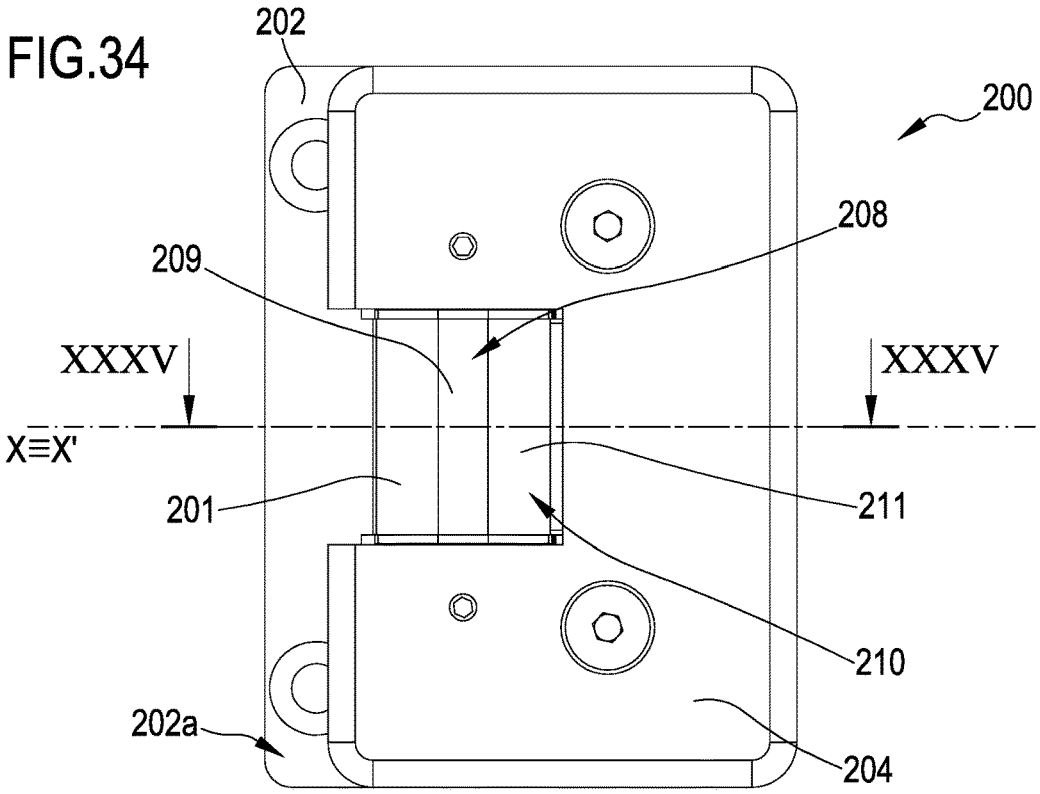
FIG.35
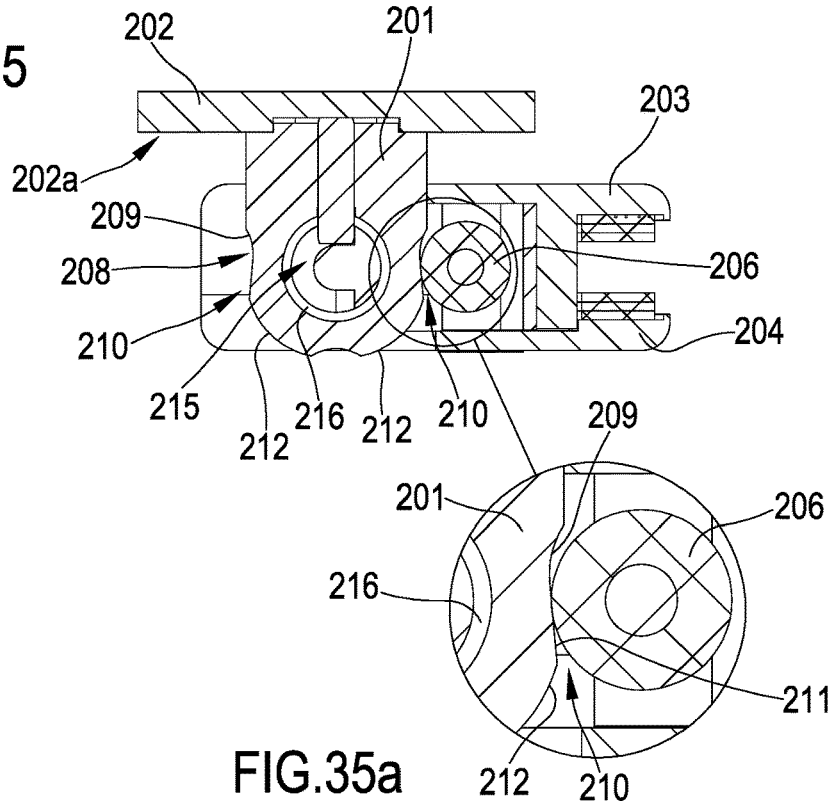
FIG.35a

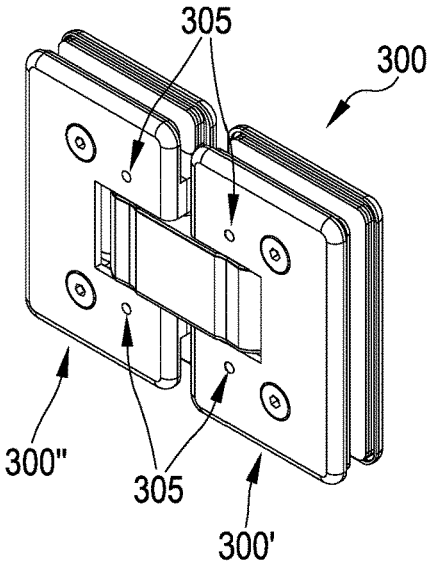
FIG.41
FIG.42
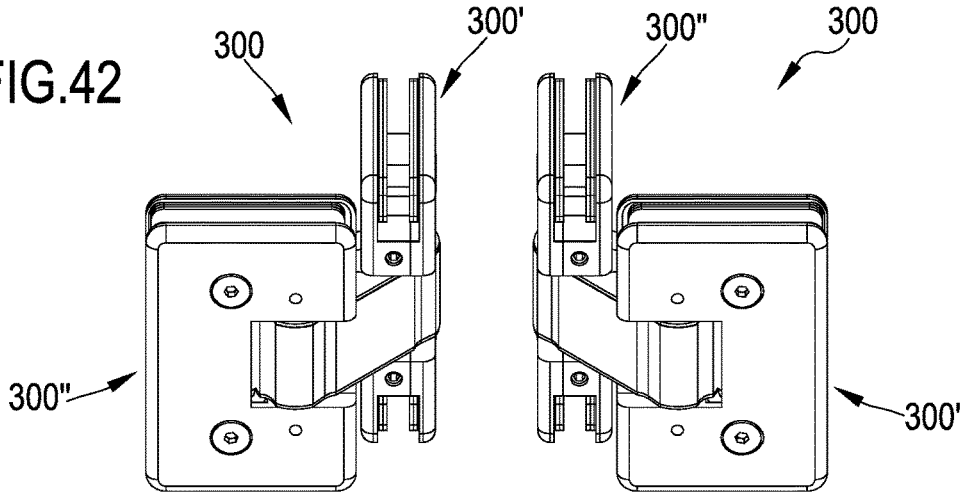
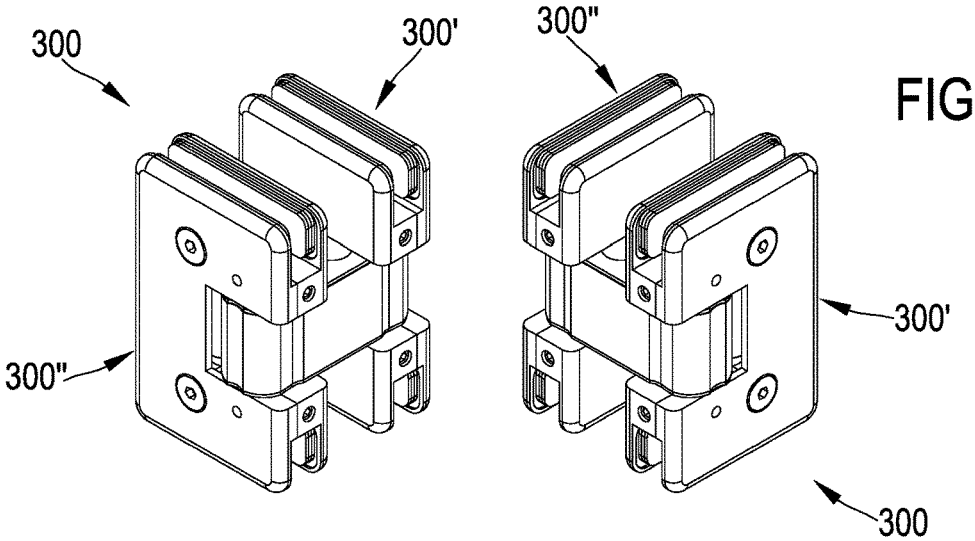
FIG.43

HINGE FOR REVOLVING SHUTTERS, ESPECIALLY OF SHOWER BOX

CROSS REFERENCE TO RELATED APPLICATIONS

This application is a national phase of PCT application No. PCT/IB2016/055632, filed Sep. 21, 2016, which claims priority to IT patent application No. 102015000054762, filed Sep. 24, 2015, all of which are incorporated herein by reference thereto.

FIELD OF THE INVENTION

The present invention concerns an improved hinge for revolving shutters, especially of shower boxes (or boxes) of baths of buildings (especially dwellings), some innovative peculiarities of which stand in a simpler and more compact construction and in an aesthetic impact more pleasant, smoother and more continuous than the comparable prior art hinges.

STATE OF THE ART

It is known that, from a constructive point of view, most of the modern showers is provided with a box (or box) consisting of a composite assembly which doses and completely protects a room accessible to people, as well as a platform where the water falls, avoiding spillages and, if necessary, protecting from sight through the partial or total opacity of the walls delimiting the room.

The shower box can be installed at a corner of a room of a building house, office, hotel and so on—, typically at a niche, at wall, or be totally free, in large dimensions environments. The box is typically formed by planar or curved bulkheads which surround the free sides of the shower room and which are made of plastic material such as translucent polymethylmethacrylate (also known by the acronym PMMA) or, in the most elegant and expensive solutions, of tempered or laminated glass.

The aforesaid bulkheads are mounted on a perimetrical frame, to which prevalent vertical development shutters are stably applied, revolvingly or slidably movable: the perimetrical frame is made of corrosion resistant materials, such as plastic, steel, or anodized aluminium and can be treated in surface in order to prevent the formation of deposits and limestone crusting. Other shower box exemplars may have masonry walls, except for the access room, closed by a panel, a door, a plastic sheet (a typical curtain).

In case of shower boxes provided with revolving shutters—properly constituting the specific field of the invention—the revolving shutters themselves are fixed to a fixed or bearing auxiliary structure (the wall of the niche where the shower box is positioned), or the uprights of the perimetrical frame, or even more to a fixed shutter adjacent to the revolving shutter (mostly for shower boxes of much higher dimensions) through one or more hinges (generally at least two) allowing rotation thereof around a substantially vertical longitudinal axis. A traditional hinge for revolving shutters, in particular a shower box, of known type include a strike block defining the aforesaid substantially vertical main axis and suitable to be made integral with one of the fixed or bearing auxiliary structures mentioned above, as well as a pair of shaped flanges opposite and facing each other, mutually coupled through fastening means and, generally although not limited, having a substantially rectangular shape with rounded vertices.

The coupling between the two shaped flanges thus allows to define between them a side recess in which the strike block is substantially housed, and a side groove which communicates with the outside and develops for three sides of the perimeter (the side which is placed close to the fixed or bearing auxiliary structure remains excluded) of each of the shaped flanges: basically, the annular groove houses a peripheral portion of the revolving shutter of the shower box.

Furthermore, the aforesaid coupling between the shaped flanges defines, in a common hinge of the known art intended to revolving shutters, especially of shower boxes, an inner seat hidden from view in which an idle roller is stably housed defining an auxiliary axis parallel to the main axis defined by the strike block and cooperating, on one hand, with the latter in such a ways as to define a first operative position, in which the revolving shutter closes the room of the shower box, and at least a second operative position, in which the revolving shutter, as a result of rotation around the main axis imparted by a user, fully opens the room of the shower box in order to allow the entry therein or exit therefrom of the person, and, on the other hand, with elastic means suitable to retain the various idle rollers stably against the strike block at each of the just mentioned operative positions.

In particular, when the revolving shutter takes one of the allowable second operative positions—as defined just above, they are one or two—it is placed according to a vertical plane defining a substantially 90° angle with the vertical plane that it defines when it is placed in the first operative position. Moreover, when the second operative positions that the revolving shutter can take are two, when the revolving shutter takes one of the allowable second operative positions, it is placed according to a vertical plane defining a substantially 180° angle with the vertical plane that it defines when it is placed in the other of the second operative positions.

In the first and (at least one) second operative position, the revolving shutter remains more or less stably in position thanks to the partial connection between the rotatable rollers and the strike block: such a connection is however easily removable by any user, suitably with his or her hand, by a simple thrust or traction exerted on one of the revolving shutter faces. At the present state of the art, this specific type of hinges for revolving shutters is suitable for particularly sophisticated applications in aesthetic terms especially in case of glass shutters—to which, while having a typically functional function, contributes with its own surface finishing and profile, generally rectangular with for instance rounded vertices.

Not surprisingly, the field market requires with increasingly insistence that the hinges for revolving shutters present a remarkable aesthetic feature, in addition to that one more traditional linked to its operation, and is thus able to considerably contribute to the overall aesthetic impact of the shower box.

Also in relation to this, the known type hinges for revolving shutters, in particular shutters intended to belong to shower boxes (or boxes), are not able to fully and completely satisfy the strict requirements of the market and, in return, they appear clearly not immune to some, however recognized, drawbacks.

The main drawback of the prior art hinges expressly intended to revolving shutters, especially in the field of bathroom, derives from the fact that the various components forming these hinges—in particular the strike block (for simplicity often also called "cake" for its shape which reminds that one of a known Christmas cake), the shaped flanges matched to it by fastening means and the idle roller contained in the inner seat defined by these shaped flanges—determine the creation of linear slots between them that, insofar as tight, are still evident and visible with relative ease even from a distance.

In addition to creating a point of discontinuity in the overall structure of the hinge and, therefore, obviously an element that affects the aesthetics of the item concerned, these linear slots negatively represent a passing point to the outside, as minimum, restrained, of the water coming out of the shower head in the room of the shower box, for example, while a person is taking a shower, with the obvious disadvantages that this entails for the environment outside the box itself, especially in houses rooms (the tiles of the floor outside wet, the joints between the tiles themselves, by absorbing water, over time tends to darken becoming ugly, the risks of slip for people, especially children, just outside of shower boxes are frequent, so that it becomes necessary to place protective and support mats adjacent to the shower box, constantly to be dried and periodically cleaned in order to prevent the aforesaid potential disadvantages).

A second drawback of the prior art referred to herein it is due to the constructional complexity of the hinges for revolving shutters, especially of the glass type for shower boxes, available today on the market, determined by a high number of mechanical components in particular, fastening means of the screw type, idle roller, elastic means of the helical springs type present in several exemplars, thickening seals and so on—which is actually not so practical, quick and easy to be assembles even for an experienced technician.

A further drawback of the known hinges for revolving shutters, resulting in what has just been highlighted, is constituted by the fact that the number of the components forming it causes high wear, or at least not limited to the maximum level, of the parts in mutual contact as well as a certain noise level during rotation of the revolving shutter around the substantially vertical main axis to open/close the shower room: this last drawback, in particular, is quite undesirable to the end user.

Another drawback of the prior art hinges for revolving shutters, especially of shower boxes, is represented by the fact that they determine a rather abrupt and not so gradual, progressive and soft rotation as it would be appropriate in order to meet the demands of the market and as the user final widely prefers.

A last but not least drawback of the hinges under consideration is related to the fact that the various idle rollers associated with respective elastic means of the helical spring type are subjected over time to flatten themselves, with consequent progressive loss of functional capacity.

SUMMARY OF THE INVENTION

Starting, therefore, from the knowledge of the above main prior art drawbacks, the present invention proposes to completely and effectively overcome them.

In particular, main purpose of the present invention is to provide an improved hinge for revolving shutters, especially of shower cabins (or boxes) where the interstitial light (or gap) between the various components in view—in particular between the strike block and the rotation means—is minimized and is still largely limited compared to equivalent hinges of known type.

Within this purpose, it is consequent task of the invention to devise an improved hinge for revolving shutters, especially of shower cabins (or boxes), which lets through outside of the shower box a water quantity, delivered by the shower head present inside the shower room, practically nil and in any case much lower than that one verifiable in the prior art hinges, resulting in a virtually water-tight seal.

It is another task of the invention to limit compared to the prior art, even up to totally prevent, the drawbacks mentioned above and resulting from the exit of water from the shower box in a bathroom of a room of a building, such as typically although not exclusively a house.

A second purpose of the present invention is to give substance to an improved hinge for revolving shutters, especially of shower cabins (or boxes), which present a more simple constructive conception with respect to those ones of known hinges comparable to it, in particular a lower number of components than the latter.

In the cognitive sphere of this second purpose, it is task of the invention to provide an improved hinge for revolving shutters, especially of shower cabins (or boxes), which, during the rotation of the revolving shutter which is coupled with—typically in at least two exemplars, one in the upper part and one in the lower part of one of the longer side edges of the shutter itself—in order to open/close the shower room, is more silent than similar hinges currently on the market.

Still, in relation to the second purpose indicated above, it is task of the present invention to indicate a hinge for revolving shutters, especially of shower cabins (or boxes), which rotates in a more gradual and controlled manner with respect to the known types hinges and which thus allows the revolving shutter to reach at least the first operative position, in which totally closes the shower room, in a smoother and less abrupt way than the current state of the art. It is a further purpose of the invention to make available an improved hinge for revolving shutters, especially of shower cabins (or boxes), which limits compared to the prior art the wear, the loss of functionality and/or the rupture of the rotation means which cooperates with the strike block during the rotation of the revolving shutter around the substantially vertical main axis.

It is a last but not least purpose of the invention to indicate a hinge for revolving shutters, especially of shower cabins (or boxes), which positively contributes to the aesthetic impact of the structural assembly which is combined with, typically in at least two exemplars, and which is able to satisfy the market demands more efficiently and more completely than the known hinges.

The foregoing purposes are achieved by an improved hinge for revolving shutters, especially of shower boxes, according to claim 1 attached hereto, as hereinafter referred for the sake of brevity.

Other technical and constructive features of detail of the improved hinge for revolving shutters, especially of shower boxes are contained in the respective dependent claims. The above-mentioned claims, hereinafter specifically and concretely defined, shall be meant as integral part of the present description.

Advantageously, the improved hinge for revolving shutters, especially of shower boxes, of the invention, reduces significantly as compared to similar prior art hinges the space (light or gap) existing between the various components assembled each other and which, in operative conditions, remain in sight, in particular making almost infinitesimal the slot which generates between the strike block and the rotation means.

This first of all allows to give to an object performing a technical function, which is precisely the improved hinge of the invention, a certain aesthetic effect, marked by a structural continuity and, therefore, a pleasantness greater than the hinges already existing on the market, and, secondarily but not less primarily, to reduce compared to the latter, the amount of water that comes out of the shower box, until almost completely prevent such an event. These advantages derive from the fact that, in the hinge of the invention, the elastic means include an elastically yielding laminar body shaped in such a way as to substantially embed in its overall encumbrance the rotation means which, in turn, comprise a single idle roller which extends for the entire height, defined parallel to the main axis around which the revolving shutter rotates, of a head portion of the strike block, opposite the base portion associated with the fixed or bearing auxiliary structure.

Still advantageously, the just described constructive features allow to make the improved hinge of the invention to be manufactured and above all assembled and applied in work more easily than the known hinges, to all the advantage of the production and installation costs (the other cost parameters to be considered, such as that one of the manpower, raw materials and/or energy used, being equal and other external contingent factors, such as the general conditions of the installation room of the shower box, being equal).

Equally advantageously, the improved hinge of the invention makes more silent the revolving shutter when it rotates around a substantially vertical main axis to open/close the room of the shower box, still thanks to the special construction just indicated above. Equally advantageously, the rotation movement of the revolving shutter about the aforesaid substantially vertical main axis, thanks to the specific minimum, essential and salient features just described of the improved hinge of the invention, is more gradual and less abrupt than what is currently verifiable in the prior art; in particular, the improved hinge of the invention allows the revolving shutter to reach the first operative position in which it completely doses the room of the shower box without performing "positive" and "negative" (i.e. to the right or to the left) oscillations with respect to a point fixed as the reference or alignment zero in such a position, or in any case by performing a minimum number of oscillations, markedly lower than that one which can be found in the known art. According to a preferred embodiment of the improved hinge of the invention, there is a clearance between the shaft defining the substantially vertical main axis and the strike block: this constructive solution allows an adjustment margin of the position of the revolving shutter, due to its rotation around said main axis, of about 7° (both in positive and in negative with respect to a fixed point as the alignment zero in the first operative position in which the revolving shutter fully closes the room of the shower box) which is higher than that one obtainable with known type hinges which, as generally known to the applicant, does not exceed 3° (positive and negative).

BRIEF DESCRIPTION OF THE FIGURES

Said purposes and advantages, as well as other ones which will emerge later, will appear to a greater extent from the following description, relating to preferred embodiments of the improved hinge for revolving shutters, especially of shower boxes, given by indicative and illustrative, but not limiting, way in relation to the enclosed drawings, in which:

FIG. 32 is the front view of the improved hinge of FIG. 29 in a possible operative position, corresponding to a first of the second operative positions defined in the following in which the revolving shutter fully opens the room of the shower box;

FIG. 33 is the view of FIG. 32 according to the cutting plane XXXIII-XXXIII;

FIG. 33*a* is an enlargement of a detail of FIG. 33;

FIG. 34 is the front view of the improved hinge of FIG. 29 in another possible operative position, corresponding to one of the second operative positions defined in the following in which the revolving shutter fully opens the room of the shower box;

FIG. 35 is the view of FIG. 34 according to the cutting plane XXXV-XXXV;

FIG. 35*a* is an enlargement of a detail of FIG. 35;

FIGS. 41-43 are three distinct assonometric views (also from double angle) of the improved hinge of FIG. 40 in three distinct operative positions (corresponding in the order, to the first operative position defined in the following in which the revolving shutter closes the room of the shower box, to a generic intermediate position in which the revolving shutter partially opens such a room of the shower box and to one of the possible second operative positions defined in the following in which the revolving shutter fully opens such a compartment).

DETAILED DESCRIPTION OF THE INVENTION

Figure 2:
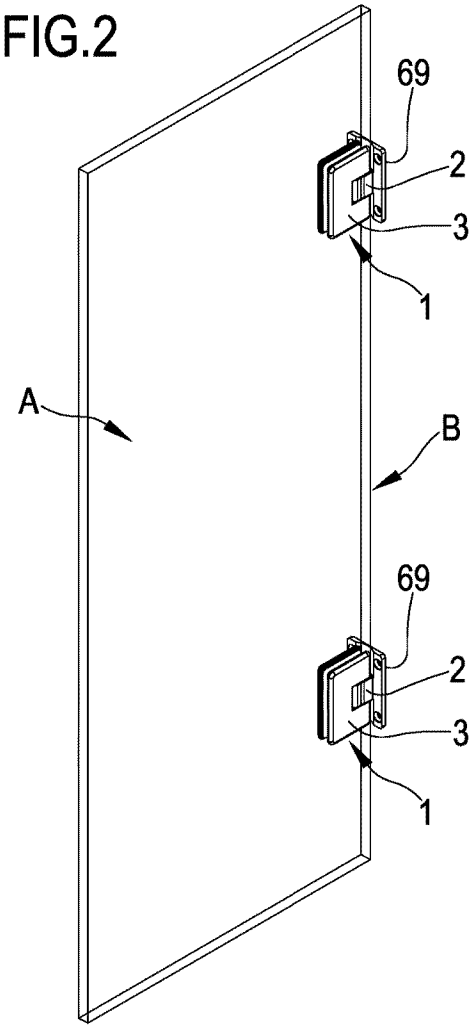
FIGS. 1 and 2 are two different assonometric views, in applicative conditions, of a first embodiment of the improved hinge of the invention, in this case of the so-called "wall" type.
Figure 1:
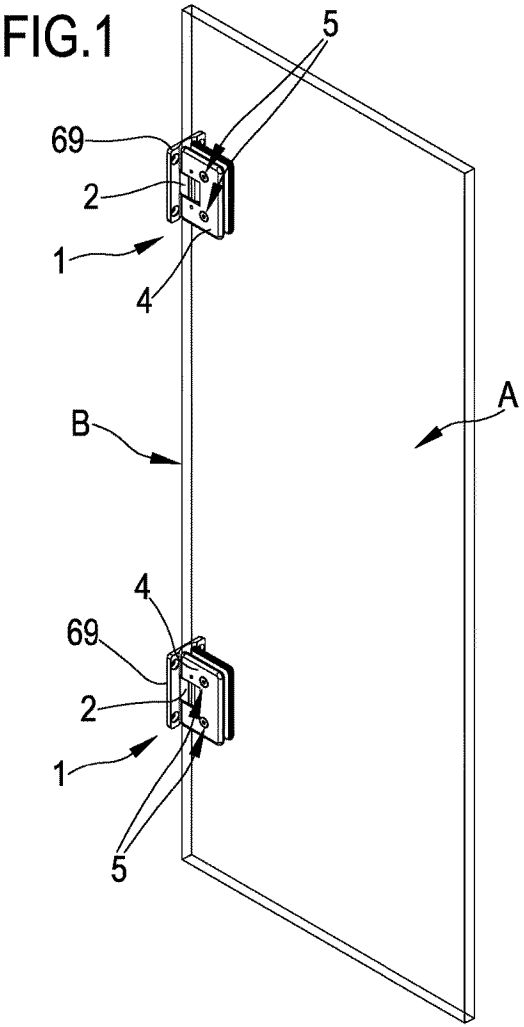

The improved hinge of the invention is illustrated in two exemplars and in application conditions in FIGS. 1 and 2, coupled with a revolving shutter A, especially of the glass type and for shower cabins (or boxes) installed in baths of buildings such as a housing unit: this type of hinge is commonly known in the market as "wall" hinge.

Figure 3:
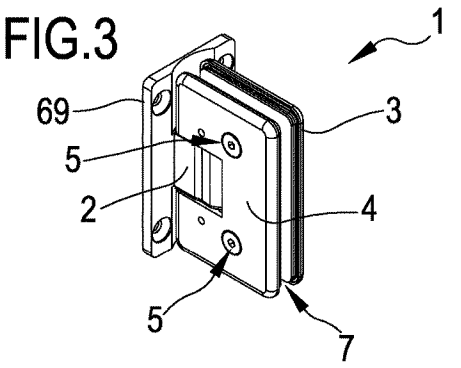
FIGS. 3-5 are three distinct assonometric views of the improved hinge of FIGS. 1 and 2 in three distinct operative positions (corresponding in the order, to the first operative position defined in the following in which the revolving shutter closes the room of the shower box and to the two respective second operative positions defined in the following in which the revolving shutter fully opens such a room)
Figure 4:
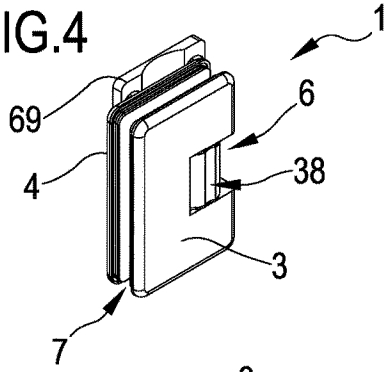
Figure 5:
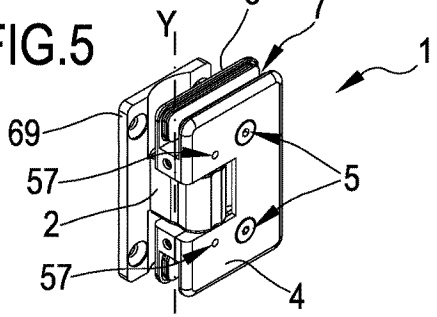
Figure 6:
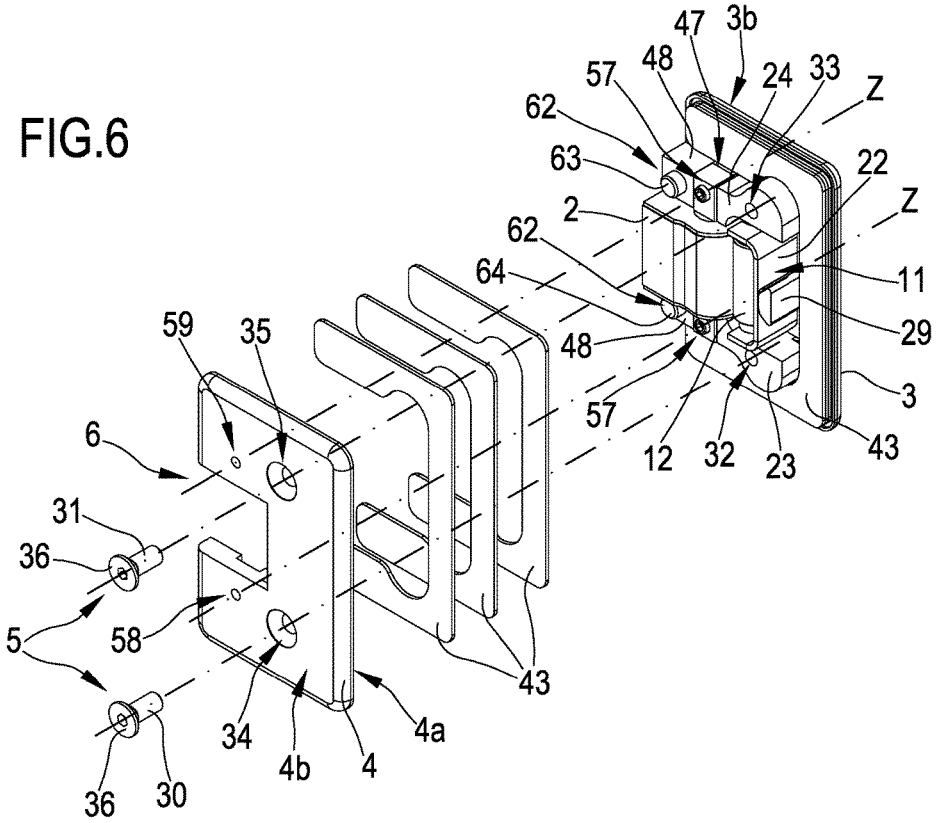
FIGS. 6 and 7 are two partially exploded views, from different angles, of FIG. 3.

It should be noted that such an improved hinge 1 firstly comprises, according, however, what already acquired in the art, a structural assembly which in turn includes:

- a strike block, on the whole indicated with 2, defining a substantially vertical main axis Y and suitable to be made integral with a fixed or bearing auxiliary structure, such as a pillar of a metallic frame fixed to a masonry wall or, more frequently as said, the masonry wall itself of a room of a house, in the specific case under description;
- a pair of shaped flanges 3, 4 opposite and facing each other, having the same profile in front view, mutually coupled through fastening means, as a whole numbered with 5, in such a way as to define:
  - a side recess 6 in which the strike block 2 is substantially housed;
  - a side groove 7, better visible in FIGS. 3-5, which communicates with the outside and, in the present case, develops on three sides (on a total of four) of the perimeter of each of the shaped flanges 3, 4: this side groove 7 receives a peripheral portion belonging to the revolving shutter A and delimiting a counter-shaped recess, not shown, having the same profile of the side groove 7 in which is perfectly conjugated;
  - an inner seat 8 hidden from view in which rotation means, indicated as a whole with 9 and visible for example in FIG. 6, are stably housed defining an auxiliary axis Y' parallel to the main axis Y of the strike block 2 and cooperating, on one hand, with the latter in such a way as to define a first operative position (see FIGS. 1 and 3), in which the revolving shutter A totally closes, remaining stable in position, a room of the shower box, and two second operative positions (see FIGS. 4 and 5), in each of which the revolving shutter A, as a result of rotation around the main axis Y imparted by a user, totally opens, remaining stable in position, the room of the shower box, and, on the other hand, with elastic means, on the whole numbered with 10 and suitable to retain the rotation means 9 stably against the strike block 2 at each of these operative positions and during the passage from one to another of them.

Figure 8:
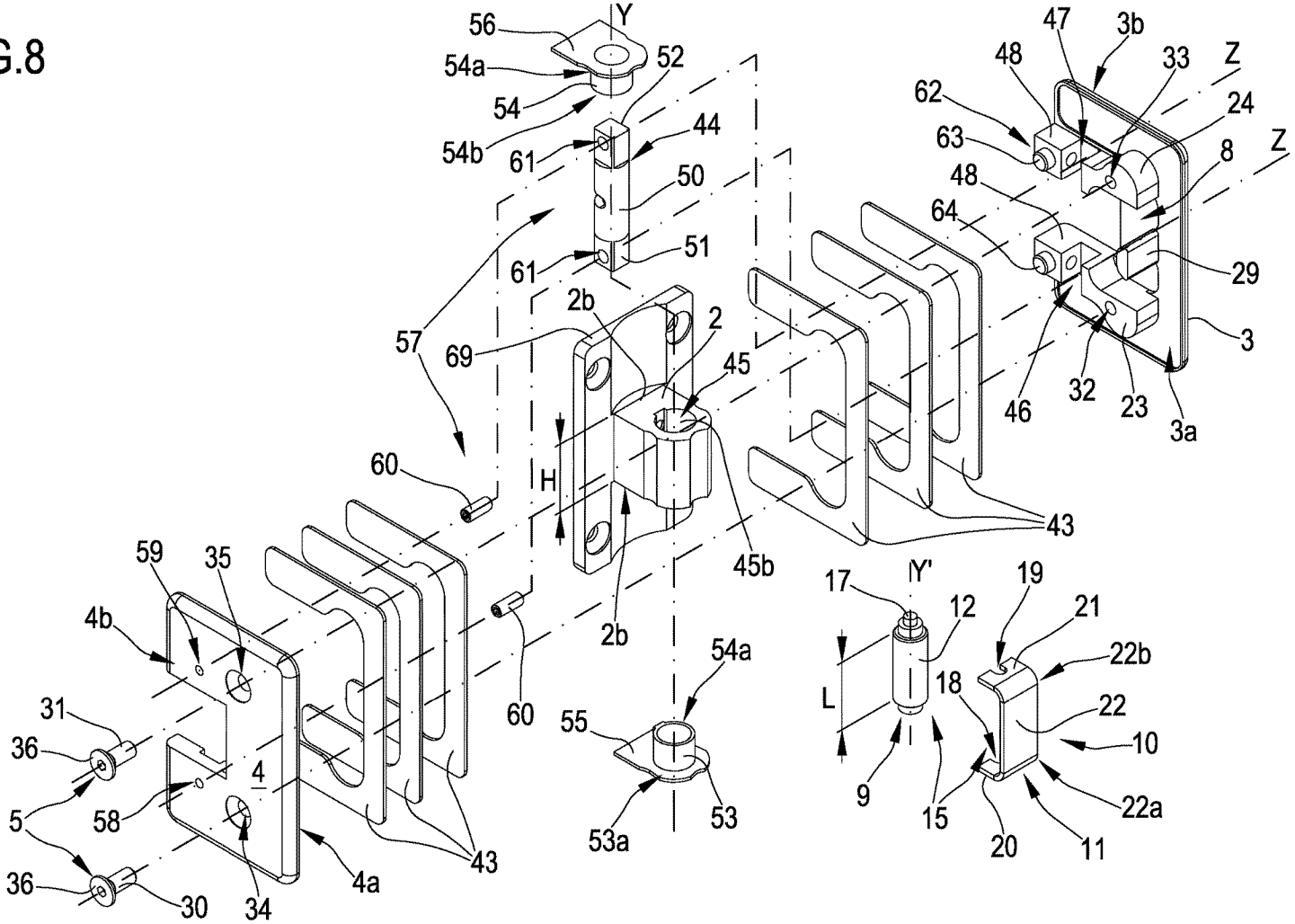
FIG. 8 is the exploded view of FIG. 3.

In accordance with the salient and main features of the present invention, as shown in particular in FIG. 8, the elastic means 10 comprise an elastically yielding laminar body 11 shaped in such a way as to substantially embed in its overall encumbrance the rotation means 9 which, in turn, comprise a single idle roller 12 extending for the entire height H, defined parallel to the main axis Y, of a head portion 13 of the strike block 2, opposite to the base portion 14 associated with the fixed or bearing auxiliary structure.

FIG. 6 shows that, suitably and conveniently, the laminar body 11 is preferably housed in the inner seat 8, thus resulting hidden from view too, and overlooks the idle roller 12: this aspect also helps to make the improved hinge 1 of the invention extremely compact and aesthetically clean, simple, linear and, therefore, pleasant.

Preferably but not necessarily, the elastically yielding laminar body 11 is made of spring steel and, in essence, performs an elastically yielding function which is progressive, not instantaneous and abrupt as in the traditional hinges, used in the prior art, equipped with elastic means of the helical springs type.

Figure 9:
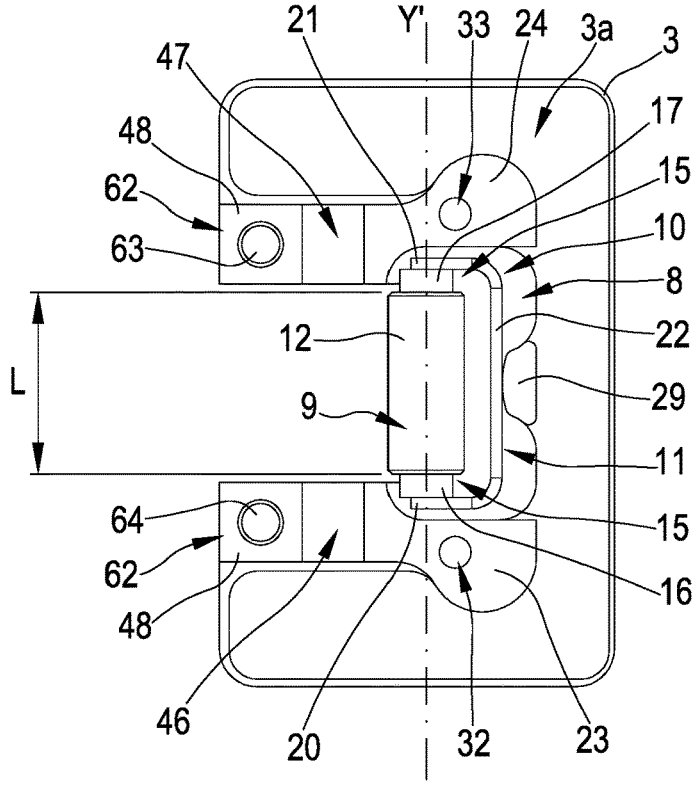
FIGS. 9 and 10 are two separate frontal views of a constructive assembly of FIGS. 6 and 7 with the elastic means in the release (or unload) condition and in the working (or load), condition respectively.
Figure 10:
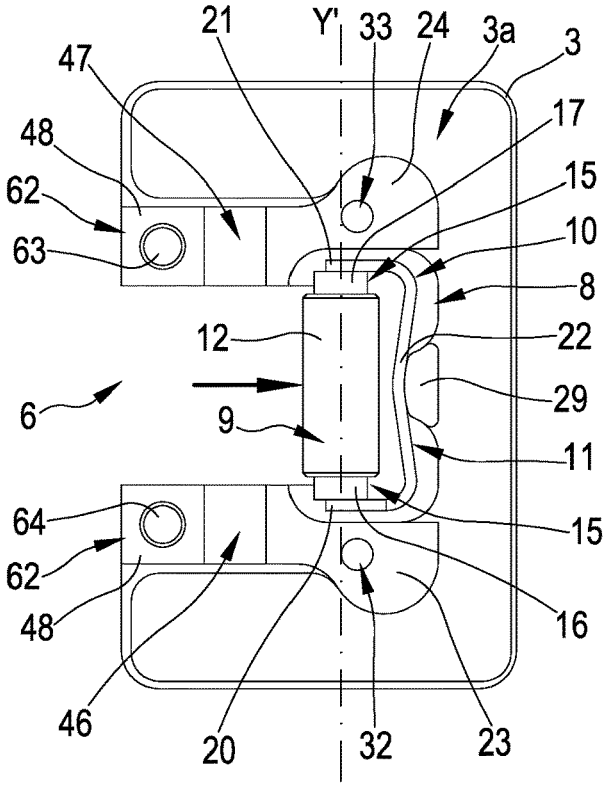
Figure 13:
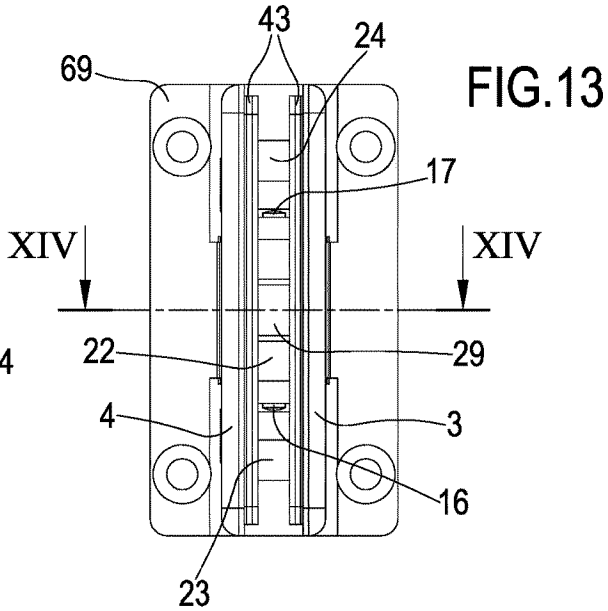
FIG. 13 is the front view of FIG. 11.

As it can well derived from FIGS. 8-10 which highlight the operation thereof, at preferred but not binding title the laminar body 11 presents in side view a profile substantially in the shape of C, U or similar: in this way, the laminar body 11 is able to define an open housing in which the idle roller 12 is located which is thus incorporated in the overall size of the laminar body 11 itself.

In FIG. 6 it is shown that the laminar body 11 and the idle roller 12 are stably kept by precision into the inner seat 8 by means of the mutual structural connection of the shaped flanges 3, 4 determined by the fastening means 5.

More in detail, in the specific example, the idle roller 12 (made for example of plastic material with high mechanical resistance and high sliding) is coupled with the elastically yielding laminar body 11 through constraint means (in the sense given by the science of construction, so that one degree of freedom in the coupling laminar body 11/idle roller 12 is achieved), as a whole numbered with 15 and visible at FIGS. 8-10.

In preferred but not binding manner, the constraint means 15 comprise a pair of side pins 16, 17, projecting axially from opposite sides from the idle roller 12, and a pair of concave open-profile recesses 18, 19, made in a pair of side flaps 20, 21 opposite each other protruding from the main central portion 22 of the laminar body 11: the side pins 16, 17 are received into the respective open-profile recesses 18, 19 where they are stably kept by means of coupling means, not shown for the sake of simplicity in the accompanying drawings and comprising for example a joint, a snap coupling, a mechanical precision interference and so on. Still FIG. 8 shows that the side flaps 20, 21 protrude from the respective opposite ends 22*a*, 22*b* of the main central portion 22 of the elastically yielding laminar body 11: side flaps 20, 21 and main central portion 22 are however monolithic each other so as to ensure to the laminar body 11, beyond to elastic flexural capacity of which it has been said, also high mechanical strength able to withstand the continuous traction and unload (or release) cycles associated with the movement of the revolving shutter A in opening and closing the shower room. The combined provisions of the FIGS. 6-10, it is observed moreover that the inner seat 8 is in this case defined at least by:

- the strike block 2 inserted into the side recess 6;
- a pair of shaped baffles 23, 24 opposite each other, arranged on the inner face 3*a* of a first of the shaped flanges 3, 4 symmetrically with respect to a first central symmetry axis X defined by the first shaped flange 3 orthogonally to the main axis Y and the auxiliary axis Y'.

In addition, the inner seat 8 is, preferably but not exclusively, also defined by a pair of shaped projections 25, 26, having the same profile of the shaped baffles 23, 24 to which are respectively facing and juxtaposed when the shaped flanges 3, 4 are stably joined each other: the shaped projections 25, 26 are arranged on the inner face 4*a* of a second of the shaped flanges 3, 4 symmetrically with respect to a second central symmetry axis X' coincident with the first symmetry axis X and belonging to the second shaped flange 4.

More specifically, the shaped baffles 23, 24 delimit by opposite sides the smaller sides of the inner seat 8 while the strike block 2 delimits one of the longer sides of the inner seat 8: the other longer side of the inner seat 8, opposite to that one which provides the strike block 2, is delimited by an abutment edge 27 defining in the inner face 4*a* of the second shaped flange 4 a surface cavity 28 and/or by a safety bracket 29 projecting along a plane perpendicular from the inner face 3*a* of the first shaped flange 3.

Figure 7:
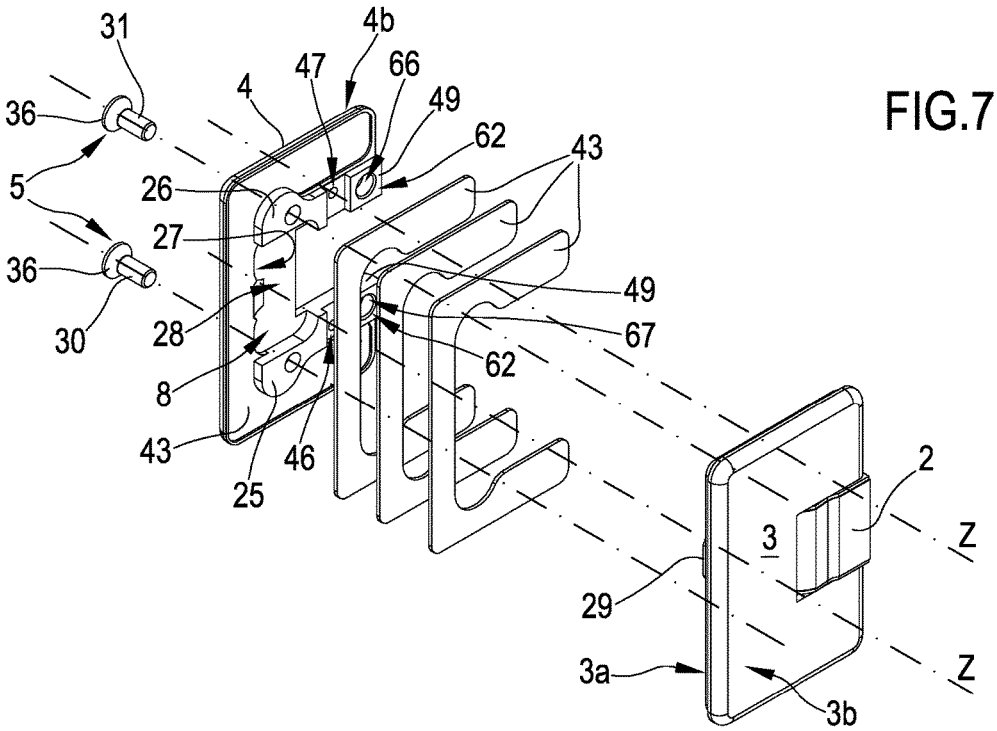

FIGS. 6-8 also illustrates that, purely by way of preferred example, the fastening means 5 comprise a pair of screws 30, 31 which engage in corresponding threaded blind holes 32, 33 made respectively in the shaped baffles 23, 24 of the first shaped flange 3 and pass in respective through holes 34, 35, each of which coaxial with one of the respective threaded blind holes 32, 33 and made in the second shaped flange 4 in such a way that the handle head 36 of the screws 30, 31 is coplanar to the outer face 4*b* of the second shaped flange 4. At the light of the above indicated for the fastening means 5, it is assumed, therefore, that the shaped flange 3 (devoid of holes on the outer face 3*b*) frontally and totally remains in view on the outside and that the shaped flange 4 frontally remains facing towards the shower room when the revolving shutter A takes the first operative closing position, to all advantage of the overall aesthetic impact of the shower box.

According to the preferred embodiment described herein of the invention, the strike block 2 of the improved hinge 1 includes angular end-of-stroke means, generally indicated with 37, yet partly visible in FIGS. 3-5 but with greater definition in FIGS. 12, 14, 16, 18, 20 and 22, preferably positioned on its outer surface 2*a*, which the idle roller 12 cooperates with in order to define for the revolving shutter A the first operative position and the two second operative positions previously introduced.

The angular end-of-stroke means 37 represent, therefore, a kind of dead point (typical of a piston of alternative volumetric internal combustion engines) in the rotation movement of the revolving shutter A around the substantially vertical main axis Y.

In a preferred but not binding way, the angular end-of-stroke means 37 comprise in this case:

- a first concave surface groove 38 made in the head portion 13 of the strike block 2;
- a second concave surface groove 39 made in each of the two side walls 40, 41, interposed between the head portion 13 and the base portion 14, of the strike block 2.

It follows that, when the revolving shutter A takes the first operative position defined above, the idle roller 12 is snap engaged and is partly contained into the first concave surface groove 38, while, when the revolving shutter A indifferently takes one of the two second operative positions specified above, the idle roller 12 is snap engaged and is partly contained into the second concave surface groove 39.

It is understood that in other embodiments of the improved hinge of the invention, not shown in the enclosed drawings, the angular end-of-stroke means could comprise a single second concave surface groove, made in only one of the side walls of the strike block in order to preferably orient the revolving shutter towards the outside of the room delimited by the shower box.

In particular, the concave surface grooves 38, 39 extend in the strike block 2 for the aforesaid entire height H which is substantially equal to the length L of the idle roller 12.

Figure 14:
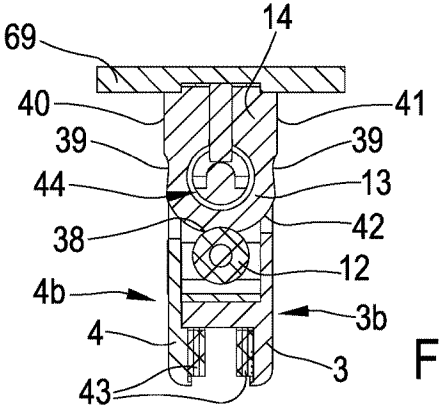
FIG. 14 is the view of FIG. 11 along the cutting plane XIV-XIV.
Figure 18:
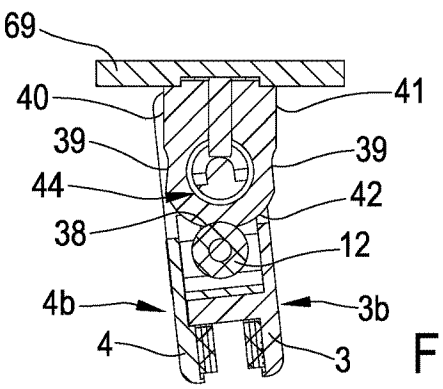
FIG. 18 is the view of FIG. 17 along the cutting plane XVIII-XVIII.
Figure 22:
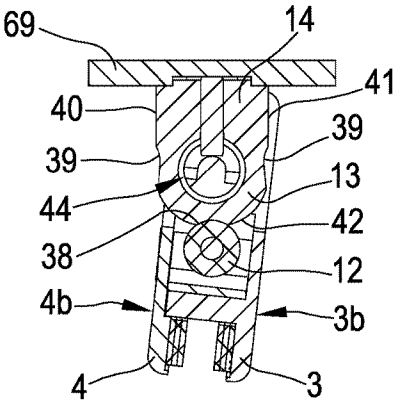
FIG. 22 is the view of FIG. 21 according to the cutting plane XXII-XXII.

Furthermore, FIG. 8 and sections of FIGS. 14, 18 and 22 emphasize that the first groove 38 is properly separated from each of the second grooves 39 by a convex surface stretch 42 belonging to the head portion 13 of the strike block 2, so that to confer to the head portion 13 itself substantially the shape of cap (from which the term of "panettone" in order to identify the strike block 2) and so that the idle roller 12, when it is in the position in which it is alternately inserted into one of the second surface grooves 39, is offset substantially of 90° with respect to the position in which it is when it is inserted into the first groove 38. Preferably, the concavity of the first surface groove 38 is more pronounced (deeper) than the concavity of the second surface grooves 39, as the sections of FIGS. 14, 18 and 22 clearly show: this because it is desirable to ensure that the revolving shutter A remains as stably as possible in the first operative position in which it doses the room of the shower box such a position corresponds, indeed, definitely to the condition in which a person is taking a shower within the shower room—, in order to try to limit the risks resulting from a sudden, fortuitous and rash disengagement of idle roller 12 from the first concave surface groove 38. Figures cited insofar (especially, FIGS. 6-8) show that, purely by preferred and non-limiting title, the improved hinge 1 of the present invention also includes a plurality of thickening gaskets 43 (six in number, in the purely indicative example described herein) interposed between the shaped flanges 3, 4, with respect to which they have the same profile, and having the function of fitting, if necessary, the improved hinge 1 to the vary of the thickness of the revolving shutter A by varying the mutual distance between the shaped flanges 3, 4: the number of these thickening gaskets 43, made of typical flexible plastic material (e.g. elastomer), will vary according to the application needs.

As far as the strike block 2 is concerned, FIG. 8 shows that it is provided with an operating shaft 44 which, in essence, defines the substantially vertical main axis Y around which the revolving shutter A rotates in order to position itself alternately between the operative positions already largely defined.

The operating shaft 44 is inserted into a through axial opening 45 made in the strike block 2 and, in this case, in two through axial holes 46, 47, coaxial each other and to the through axial opening 45 and defined by the union of the shaped flanges 3, 4.

More specifically, each of the through axial holes 46, 47 is defined between a support tooth 48 and one of the shaped baffles 23, 24 of the first shaped flange 3 and between a relief rib 49 and one of the shaped projections 25, 26 of the second shape flange 4.

Preferably but not necessarily, the operating shaft 44 includes:

- a cylindrical central body 50, housed in the intermediate zone of the through axial opening 45 of the strike block 2, such an intermediate zone being included in the side recess 6;
- two edged end portions 51, 52, projecting axially from opposite sides from the cylindrical central body 50, housed in the order one for each of the aforesaid through axial holes 46, 47.

It is understood that in other embodiments of the improved hinge of the invention, not represented, the operating shaft could comprise only an edged end portion, yet sufficient in order to lock in position the two ends of the operating shaft itself rendering it a fulcrum useful for rotation; in return, it could be necessary to get only one through axial hole from the union of two shaped flanges in which the single edged end portion of the operating shaft precisely engages.

Again, advantageously, the strike block 2 is, preferably, provided with a pair of self-lubricating bushes 53, 54, optimally visible always in FIG. 8, each of which is arranged adjacent to a respective axial stretch of the inner wall 45*b* that delimits the through axial opening 45 in such a way as to limit the friction of the operating shaft 44 when, by rotating around the substantially vertical main axis Y, cooperates by contact with the self-lubricating bushes 53, 54 which are held in position by respective folded safety and buffer washers 55, 56 arranged close to a side edge 2*b* of the abutment block 2 and associated (in this case monolithically, by way of example) to a corresponding ends 53*a*, 54*a* of the self-lubricating bushes 53, 54.

The self-lubricating bushes 53, 54 are inserted from opposite sides, until they mutually touch at the respective end 53*b*, 54*b*, inside the through axial opening 45 of the strike block 2 and, as the idle roller 12, are made of plastic materials at high technology, of the low friction coefficient type (also known as self-lubricating tecnopolymers), such as for instance polytetrafluoroethylene (PTFE), polyoxymethylene (POM), polyacetylene (PA), polyethylene (PE), suitable to ease the mutual sliding without need for lubrication between parts in mutual contact.

It is not however excluded that in other embodiments of the improved hinge of the invention, not shown, the strike block is provided with a single self-lubricating bushing inserted inside the through axial opening for the entire length of the strike block itself and suitably kept in position by a single folded safety washer or other equivalent systems. In preferred and advantageous way, as yet previously said, the operating shaft 44 is also housed in the through axial holes 46, 47 by providing what is called mechanical tolerance or "clearance" (small dimensional difference between two mechanical members coupled each other): as it will be explained immediately below, this allows, if required for application needs, a first kind of adjustment of the position of the revolving shutter A—by means of an its slight but significant rotation around the main axis Y, in order to correctly place it in the first position of complete closure of the shower room, perfectly perpendicular to the masonry support wall or aligned to a fixed adjacent panel—and such an adjustment, which can be also find in similar prior art hinges, is better, more accurate and wider than these, being able to reach also values of about 7° (either positive or negative with respect to a point fixed as the reference zero).

Indeed, the improved hinge 1 of the present invention comprises, advantageously though not essentially, adjustment means, overall indicated with 57 and visible starting from FIG. 6, associated with the operating shaft 44 and accessible by means of a handling tool—such as for example a mechanical Allen key, not shown—actuated by the operator and by means of in this case (at preferred but non-limiting title) two auxiliary through holes 58, 59 parallel each other made in one of the shaped flanges 3, 4 (namely, in the specific case, the shaped flange 4).

These auxiliary through holes 58, 59 allow to correctly position the revolving shutter A in the first operative position, according to the application and/or installation needs and/or constraints allowing its rotation around the main axis Y, and around at least one secondary axis Z transverse to the main axis Y.

In detail, the adjustment means 57 comprise, in a preferred but not exclusive way, a grain 60, visible in FIGS. 6 and 11-22, which can be actuated in rotation by the operator by means of the aforesaid handling tool and inserted into a threaded transverse hole 61 made in the two edged end portions 51, 52 of the operating shaft 44 along the secondary axis Z orthogonal to the main axis Y, the auxiliary axis Y' and the first symmetry axis X.

Figure 11A:
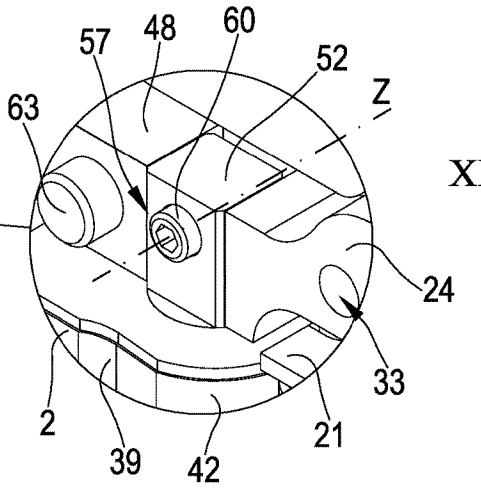
FIG. 11*a* is an enlargement of a detail of FIG. 11.
Figure 11:
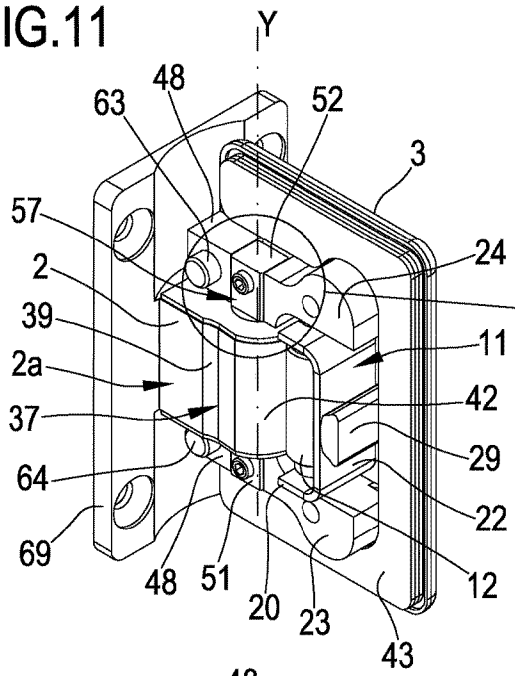
FIG. 11 is an enlarged detail of FIG. 6.
Figure 12:
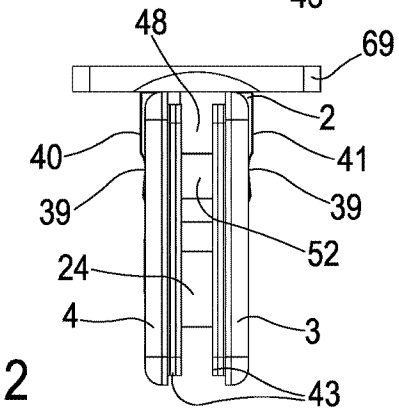
FIG. 12 is the top plan view of FIG. 11.
Figure 17:
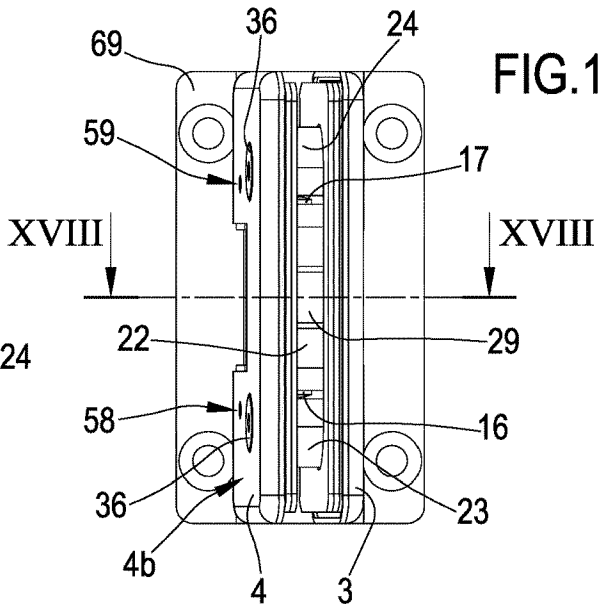
FIG. 17 is the front view of FIG. 15.
Figure 15A:
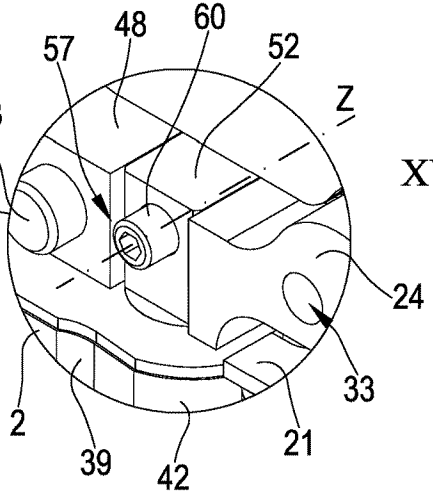
FIG. 15*a* is an enlargement of a detail of FIG. 15.
Figure 15:
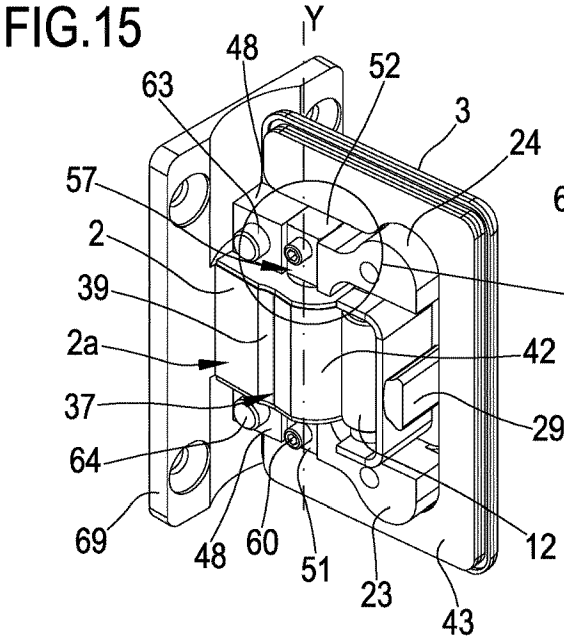
FIG. 15 is the same enlarged detail of FIG. 11 but in a different operating position.
Figure 16:
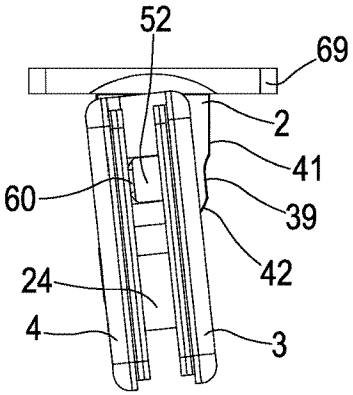
FIG. 16 is the top plan view of FIG. 15.
Figure 21:
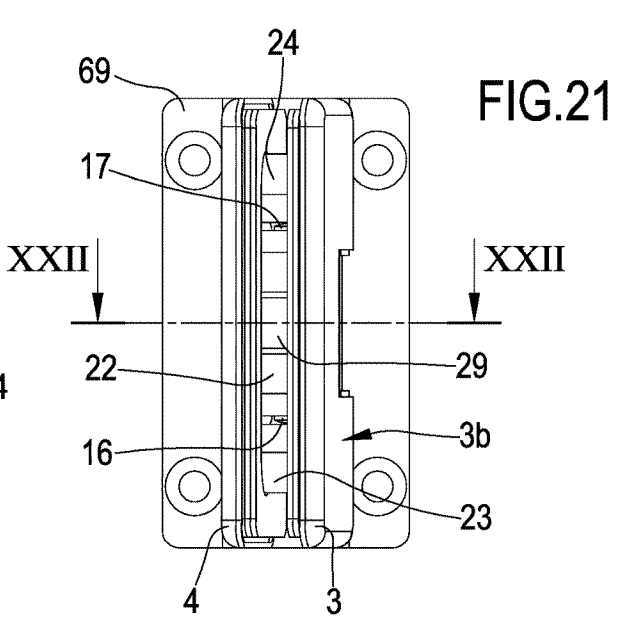
FIG. 21 is the front view of FIG. 19.
Figure 19A:
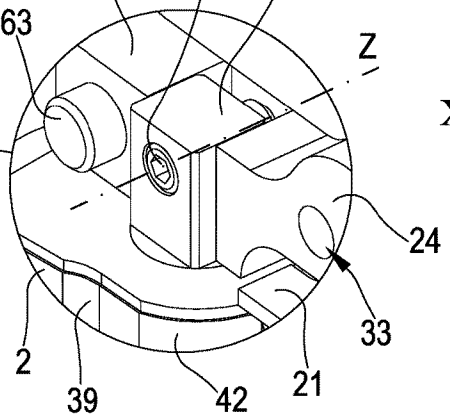
FIG. 19*a* is an enlargement of a detail of FIG. 19.
Figure 19:
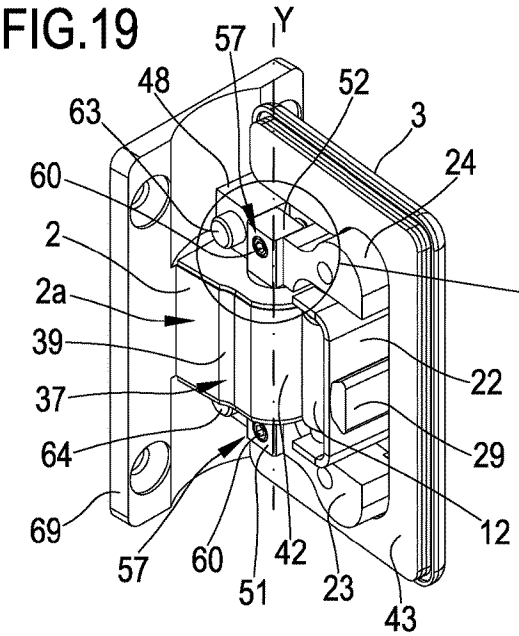
FIG. 19 is the same enlarged detail of FIGS. 11 and 15 but in a further different operating position.
Figure 20:
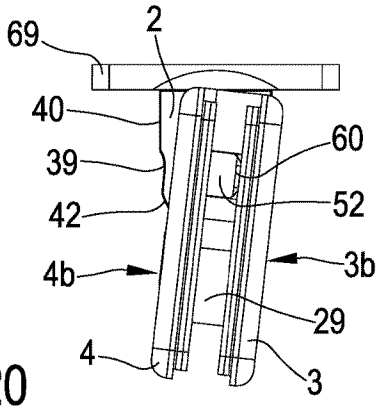
FIG. 20 is the top plan view of FIG. 19.

It follows that, starting from the position of the revolving shutter A shown in the first group of FIGS. 11-14 (in which, in particular, the grain 60 takes the position visible in the enlargement of FIG. 11*a*), if the application needs and/or installation constraints require it, it is possible to rotated for example counter-clockwise, both the grains 60 associated with their respective edged end portions 51, 52 and thus obtain the counterclockwise rotation of a few degrees—up to a maximum of 7°, value higher than the allowed adjustment of the hinges of known type, as already said—of the revolving shutter A around the main axis Y in such a way as to place it, for example, in the position shown in the second group of FIGS. 15-18 (in which the grain 60 takes the position visible in the enlargement of FIG. 15*a*). If, instead, the application needs are exactly opposite to those ones just indicated, the operator (installer), starting for example from the position of the revolving shutter A shown in the first group of FIGS. 11-14, rotates clockwise both grains 60 associated with the respective edged end portions 51, 52 in order to get the rotation in a clockwise direction of a few degrees—still up to a maximum of 7°—of the revolving shutter A around the main axis Y so as to place it, for example, in the position shown in the third group of FIGS. 19-22 (in which the grain 60 takes the position visible in the enlargement of FIG. 19*a*).

Figure 23:
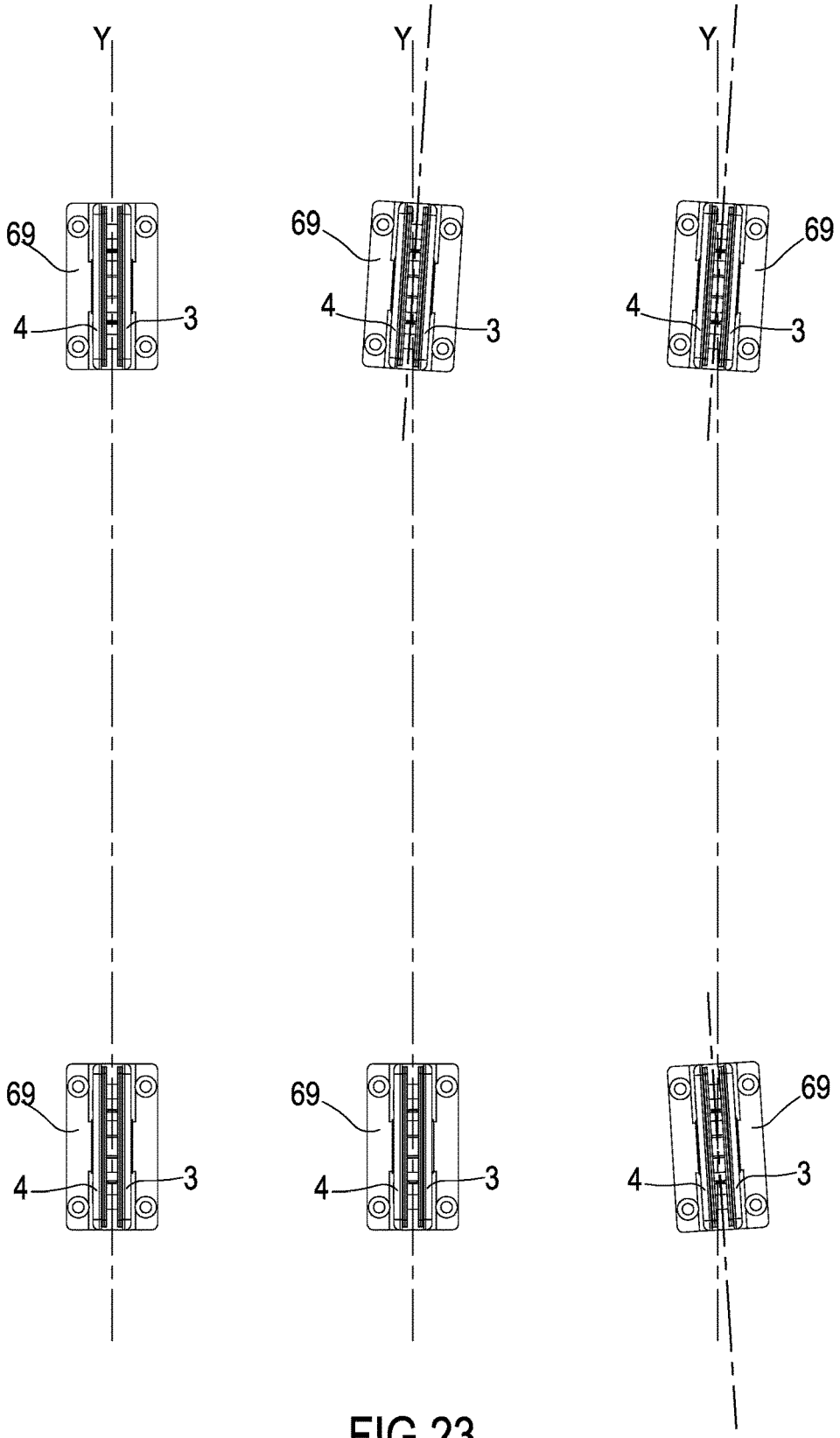
FIG. 23 is an assembly of three schematic front views of the improved hinge of FIGS. 1 and 2 which shows a possible adjustment system thereof.

FIG. 23 shows, instead, a possible adjustment of the position of a revolving shutter A even in case of incorrect positioning of the support plate 69: the adjustment means 57 belonging to the improved hinge 1 under description allow to compensate for the effects of such a mounting error (which in FIG. 23 has been exaggerated to some extent, for indicative purposes) by placing the revolving shutter A in the correct desired position: this occurs by means of the handling of the structural assembly formed by the shaped flanges 3, 4 and the adjustment means 57 integral to them, while the support plate 69 remains fixed together with the strike block 2 during adjustment.

In essence, therefore, during any type of adjustment of the position of the improved hinge 1 of the invention (required by the circumstances) allowed by the adjustment means 57, the support plate 69 and the strike block 2 remain fixed in position, while the shaped flanges 3, 4 are movable and change their position as a result of the operation of the adjustment means 57.

It is clear that the improved hinge 1 of the invention, in the allowed structural limits, could allow for the adjustment of the position of the revolving shutter A which provides to rotate in a first direction, for example clockwise, the grain 60 associated for example with the edged end portion 51, and in a second direction, for example counterclockwise, and however opposite to the first direction, the other grain 60 associated with the edged end portion 52 of the operating shaft 44.

The possibility to get the above described adjustments is stopped when the edge end portion 51, 52, under the thrust of the grain 60 screwed in one direction or in the other by the operator, interferes with the inner face 3*a* and 4*a*, respectively, of the shaped flanges 3 and 4. These are not however the only adjustments of the position of the revolving shutter A (performed so that such a position is that one desired because actually correct) allowed by the improved hinge 1 of the invention by means of which, indeed, other adjustments are possible by actuating in rotation—counterclockwise or clockwise, depending on the needs—only one of the two grains 60 and thus rotating slightly the revolving shutter A around the secondary axis Z defined by the grain 60 which is left fixed and which thus acts as a fulcrum (in this case, the revolving shutter is inevitably put in tension, however the adjustment is still effective due to the fact that the glassy material, with which the revolving shutters coupled with the improved hinges of the type claimed herein are generally made of, presents an inherent albeit minimum elastic capacity which allows a slight but significant, however, non-destructive and non-invasive, flexure).

This type of adjustment allows to compensate, for example, any (even marginal but significant in this kind of technical applications) errors in the execution of holes in the masonry wall, made by the operator.

In addition, since the improved hinge 1 of the invention is not installed in a single, but in at least two, exemplars, in order to allow the movement of the revolving shutter A, the adjustment means 57 of the type described above allow to multiply the adjustments just indicated if the adjustment means 57 of only one of the improved hinges 1 installed are operated, with consequent facilitation of the installation work of the operator compared to the current state, since the range of the adjustments offered by the invention is considerably wider compared to that one which can be found in equivalent hinges of known type. In summary, therefore, the possibilities of adjustment of the position of the revolving shutter A, obtainable in the improved hinge 1 of the invention through the adjustment means 57 of the type described above, are several, in number definitely greater than that one offered by similar hinges of the prior art, being the revolving shutter A be adjusted by its (direct or indirect) rotation around a series of axes: these number of adjustments increases exponentially in case in which the at least two improved hinges 1 of the invention are combined with the revolving shutter A.

The improved hinge for revolving shutter, object of the present invention, thanks to the adjustment means of the type just described which is favorably equipped with, allows, in all evidence, precise, micrometric but at the same time very simple and rapid adjustments, being executable without manually handling and without disassembling the shaped flanges, as it typically happens in the prior art: this leads to significant advantages in terms of installation and aesthetics of the revolving shutters if shower boxes. In FIGS. 6-22 it is also shown that, preferably but not necessarily, although advantageously, the shaped flanges 3, 4 comprise centering means, indicated overall by 62 and suitable to ease the correct mutual alignment of the profiled flanges 3, 4 themselves before the final application of the fastening means 5 with which are made integral each other.

In particular but not binding way, the centering means 62 in this case include:

- a pair of reference marks 63, 64, each projecting from the support tooth 48 yet introduced and arranged on the inner face 3*a* of a first of the shaped flanges 3, 4, and particularly the shaped flange 3;
- a pair of blind holes 66, 67, each of which is coaxial to one of the reference marks 63, 64, made in the relief rib 49 yet introduced and placed on the inner face 4*a* of a second of the shaped flanges 3, 4, and particularly the shaped flange 4, and having the same profile of the support tooth 48, each reference mark 63, 64 engaging inside the respective blind hole 66, 67 which it is coaxial to.

Figure 24:
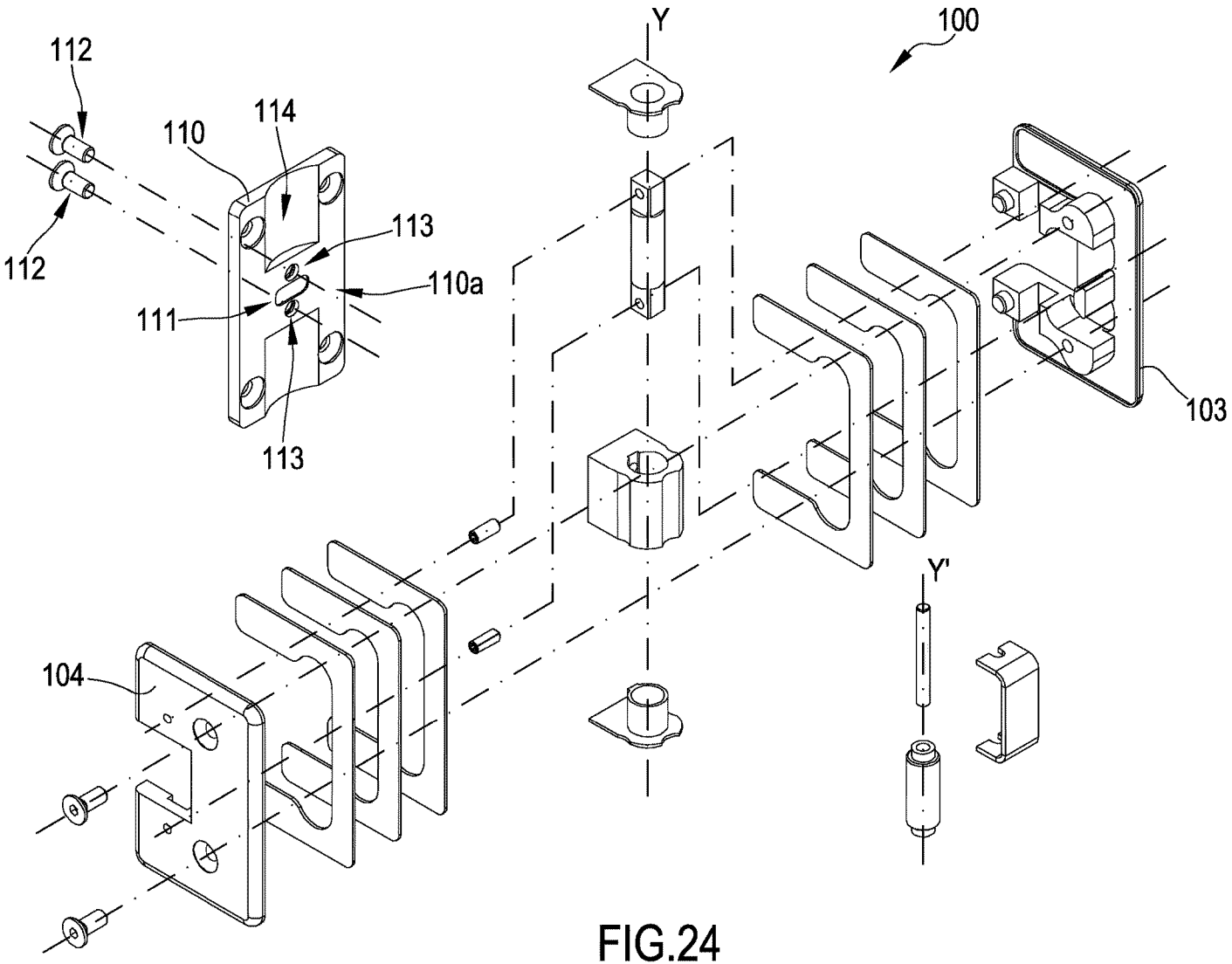
FIG. 24 is an exploded assonometric view of a second embodiment of the improved hinge of the invention, in this case of the so-called "centered" type.

FIG. 24 shows a first possible embodiment of the invention in which the improved hinge, now globally numbered with 100, for revolving shutters A differs from that one previously described and indicated with 1 essentially for the support plate 110 with which the improved hinge 100 is stably fixed to the fixed or bearing auxiliary structure consisting also in this case, preferably, by a masonry wall of an environment (such as a bath) of a building.

Indeed, the support plate 110 of the improved hinge 100 differs from the support plate 69 of the improved hinge 1 by the fact of presenting centrally a slotted through opening 111 which allows to perfectly center the improved hinge 100, in the correct position, on the masonry wall: just for this reason, the improved hinge 100 of the invention is defined of the "centered" type.

The stable application of the support plate 110 also takes place in this case by means of anchoring screws 112 inserted into respective at least in part threaded through holes 113, made in the support plate 110, and in corresponding blind holes (not visible) made in the masonry wall so as to be coaxial to the respective through holes 113.

It should be noted also in this case the appropriate concavities of outer surface 114 present on the front wall 110*a* of the support plate 110, which allows rotation about the main axis Y, clockwise and counterclockwise, of the shaped flanges 103, 104 avoiding that the latter in a rash way rub against the support plate 110, ruining it.

Figure 25:
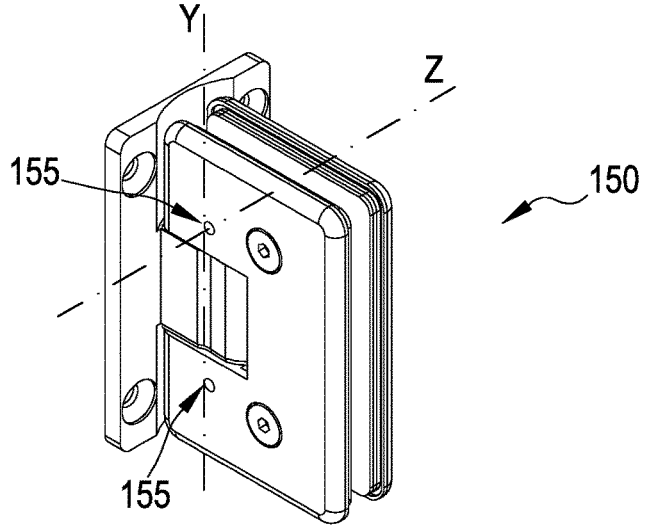
FIGS. 25-27 are three distinct assonometric views of a third embodiment of the improved hinge of the invention, even of the so-called "centered" type, in three distinct operating positions (corresponding in the order, to the first operative position in the following referred to in which the revolving shutter closes the room of the shower box and to the two respective second operative positions defined in the following in which the revolving shutter fully opens such a room)
Figure 26:
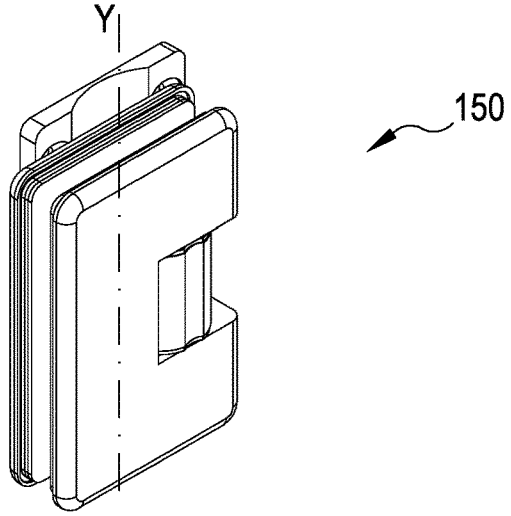
Figure 27:
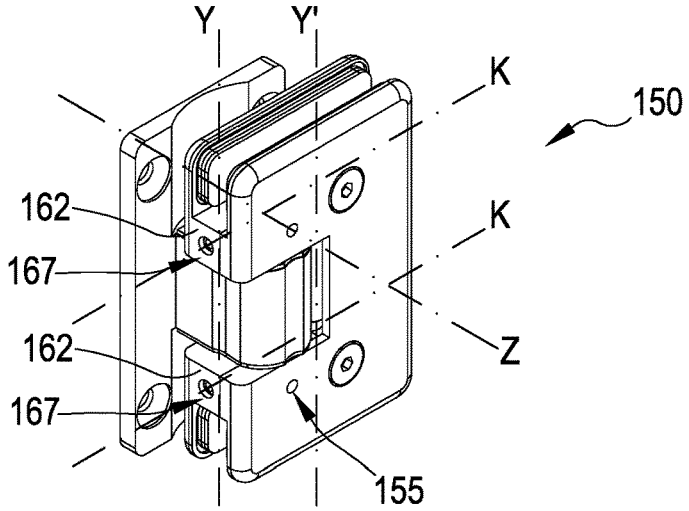
Figure 28:
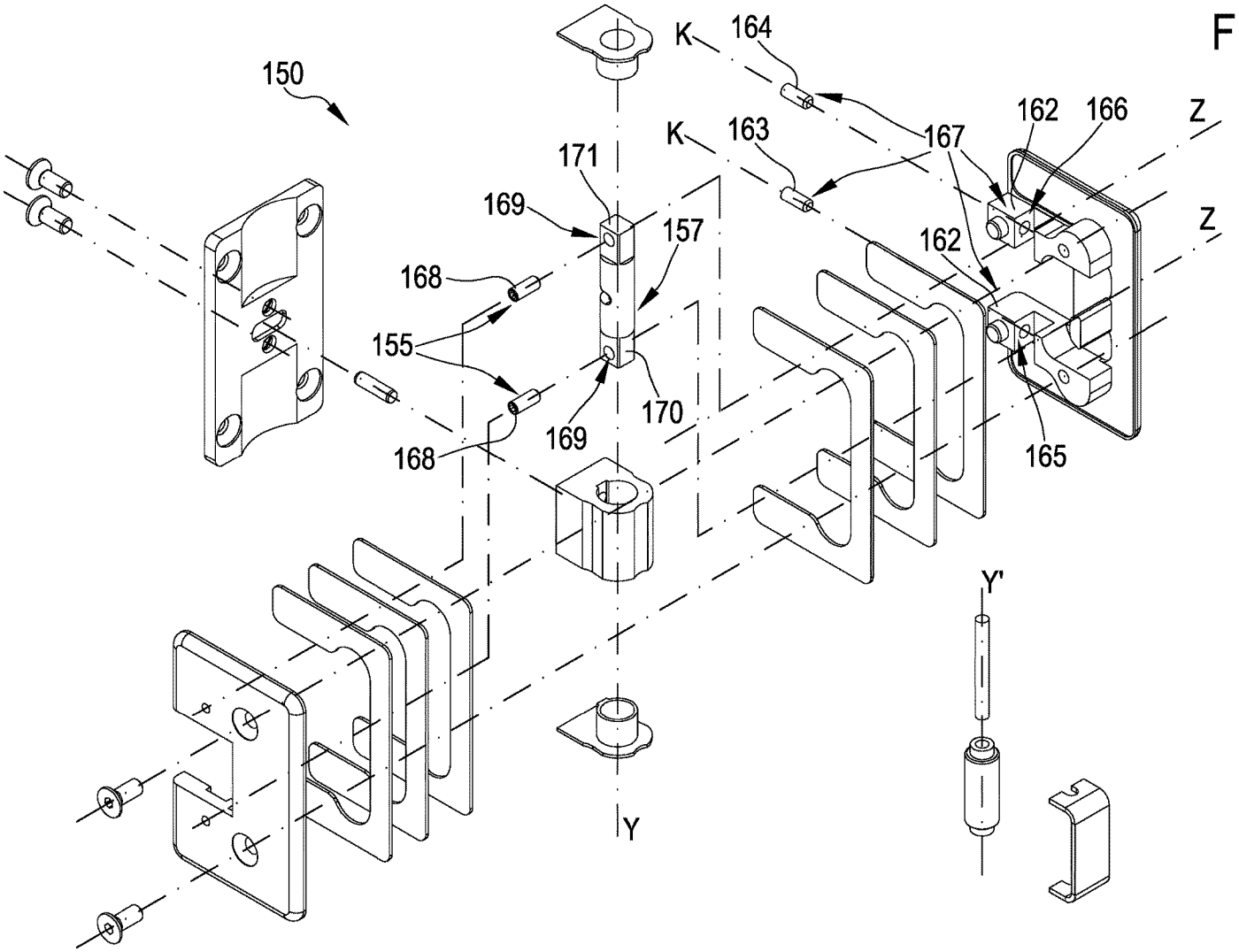
FIG. 28 is the exploded view of FIGS. 25, 26 and 27.

The subsequent FIGS. 25-27, exactly correspondent as illustrative principle to the FIGS. 3-5 mentioned above for the improved hinge 1, show a third possible embodiment of the invention in which the improved hinge, now globally numbered with 150, differs from the improved hinges 1 and 100 of the invention already described for the fact of also comprising locking means, indicated as a whole with 167 and highlighted in FIG. 27 and in detail in FIG. 28.

The locking means 167 are associated with the operating shaft 157 and are actuated by the operator to definitely and stably lock the adjustment means, as a whole numbered with 155, in the position in which the revolving shutter A correctly takes the first operative position of total closure of the room of the shower box, often although not always obtained as a result of the operator's intervention in order to change the position of the adjustment means 155, in particular the grain 168 in threaded transverse hole 169 of the two edged end portions 170, 171 of the operating shaft 157.

By way of preferred but non-exclusive and limiting example, the locking means 167 include, in particular, a pair of pins 163, 164 inserted into respective auxiliary through openings 165, 166 made in the support teeth 162 according to a linear axis K perpendicular to the secondary axis Z according to which, in these support teeth 162, the threaded transverse hole 169 is made in which the 168 of the adjustment means 155 engages: in order to perform the locking function, each of the pins 163, 164 protrudes from the respective support tooth 162 up to interfere with a portion of the edge end portions 170, 171, as it is derived from FIG. 28 that, as illustrative principle, corresponds to FIG. 8 before described.

Figure 29:
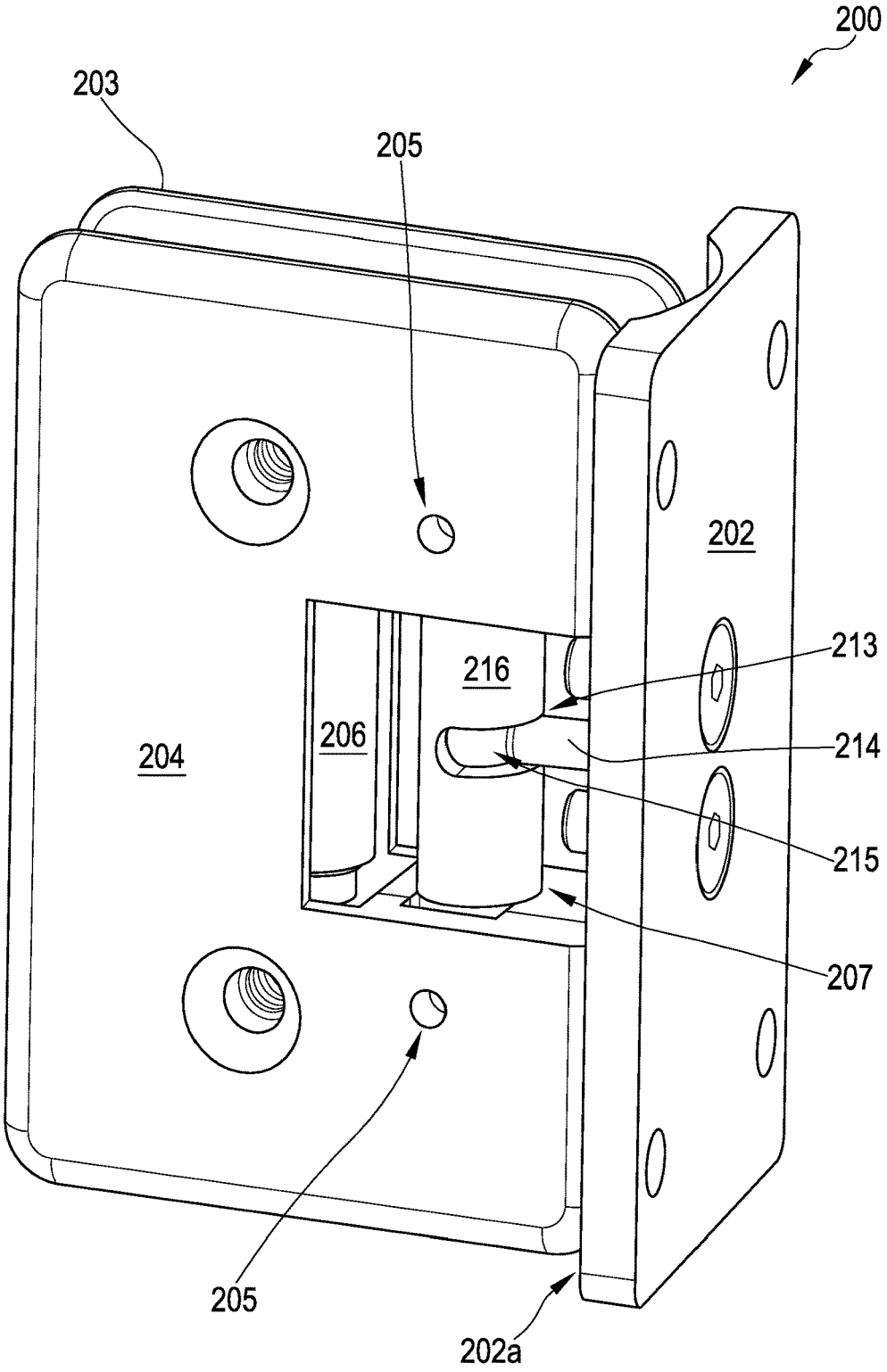
FIG. 29 is the partial and simplified assonometric view of a fourth embodiment of the improved hinge of the invention, of the "wall" type.

The next FIG. 29 relates to a further possible embodiment of the invention in which the improved hinge is now globally numbered with 200 and better highlights what has already been verified and provided in the hinges 1, 100 and 150 previously described, namely the form/profile for each of the second concave surface grooves 209 of the angular end-of-stroke means, numbered on the whole with 208 and better visible in FIGS. 30-35.

Indeed, it is evident that each of these second concave surface grooves 209—also in this case, preferably, two in number—includes guide means, indicated as a whole with 210, suitable to keep the improved hinge 200 always in thrust of opening of the room of the shower box, and therefore, to turn away the revolving shutter A from the first operative position up to keep it, when it takes each of the second operative positions of opening of such a room, always (whatever the application condition is) in a position such that the longitudinal plane (defined by its side faces) of the revolving shutter A defines an angle of substantially 90° with the plane defined by the revolving shutter A if the latter, in the first operative position of closure of the room of the shower box, is positioned according to a longitudinal plane substantially perpendicular to the plane of the rear fixed or bearing auxiliary structure.

More specifically, in the position of opening of the shower box room, the revolving shutter A is always (whatever the installation constraints are) positioned parallel to the front face of the fixed or bearing auxiliary structure, as shown by FIGS. 33*a* and 35*a* enlargements, even when the correct position of the revolving shutter A itself, in the first operative position of closure of the shower room, does not allow to place it along a longitudinal plane which in substance crosses orthogonally the plane defined by the auxiliary structure: this just thanks to the guide means 210 which the improved hinge 200 of the invention is provided with. In summary, thus, if the application or installation needs that, in order for the revolving shutter A to correctly take the first operative position of closure of the room of the shower box, the revolving shutter A itself might be placed according to a longitudinal plane defining an acute inner (or obtuse outer) angle with the plane of the fixed or bearing auxiliary structure which is fixed to the support plate 202, the guide means 210 allow to position the revolving shutter A always correctly in the second operative position where it is placed frontally to the plane defined by the fixed or bearing auxiliary structure (or, in other words, substantially at 90° with respect to the position taken by revolving shutter A when the longitudinal plane defined thereby is orthogonal to the plane defined by the fixed or bearing auxiliary structure).

This advantageous situation cannot be verified in the prior art, since the hinges of the known type, equivalent to that one of the invention, do not allow to achieve this remarkable result: at the current state of the art, when indeed, following the installation, the revolving shutter A is placed along a longitudinal plane which intersects obliquely (not orthogonally) the plane defined by the rear fixed or bearing auxiliary structure, the positioning of the revolving shutter A in the second operative positions (in which it opens the room of the shower box) is incorrect and inaccurate since the revolving shutter A, on one hand, negatively bumps with the auxiliary structure and, on the other hand, partially occupies the room of the shower box, with the obvious disadvantages that this implies in both cases (the revolving shutter A and/or the strike block gradually get ruined over time, under the continuous accidental and uncontrolled impacts against the fixed or bearing auxiliary structure they suffer, and represents an obstacle to the movement of the persons inside the room of the shower box as well as an element negatively affecting the aesthetic impact perceived by the end user). Not by chance, in order to avoid some of the aforementioned adverse effects, in the known art the application of appropriate laminar protection (typically elastically yielding) elements is used, applied to the outer surface of the strike block, at the part that accidentally bumps against the auxiliary structure rear to it.

More precisely, the guide means 210 comprise a tapered flat wall 211, better seen in the section of FIGS. 33 and 35, which belongs to each of the second surface grooves 209 of the strike block 201 and linearly converges from the end part of the convex surface stretch 212 towards a first symmetry axis X defined by the first shaped flange 203 (with which the second symmetry axis X' of the second shaped flange 204 still coincides) up to a concave end portion of each of the second surface grooves 209 themselves.

The provision of the guide means 210 is particularly useful when the adjustment of the position of the revolving shutter A by means of the adjustment means, indicated as a whole with 205, in order to align it correctly in the first position of total closure of the shower room, determines for this one a position of the type illustrated in FIGS. 15-18 or in FIGS. 19-22, in which the rear edge B of the revolving shutter A is positioned according to a plane affecting (it is not parallel) the plane defined by the front face of the fixed or bearing auxiliary structure.

In such a condition of the revolving shutter A in the first operative position as defined in the course of the present description, the passage of the revolving shutter A itself from the first operative position to any one of the second operative positions, the guide means 210 lacking, would be difficult and should be forced by a pushing or pulling by the person, while such an action is not absolutely necessary in the improved hinge 200 of the invention.

It is understood that alternative and optional embodiments of the improved hinge of the invention, not represented in the accompanying drawing tables, could exist in which the second concave surface groove, as well as furthermore also the first concave groove surface, may present a profile in the shape of an arc of regular circumference.

Figure 30:
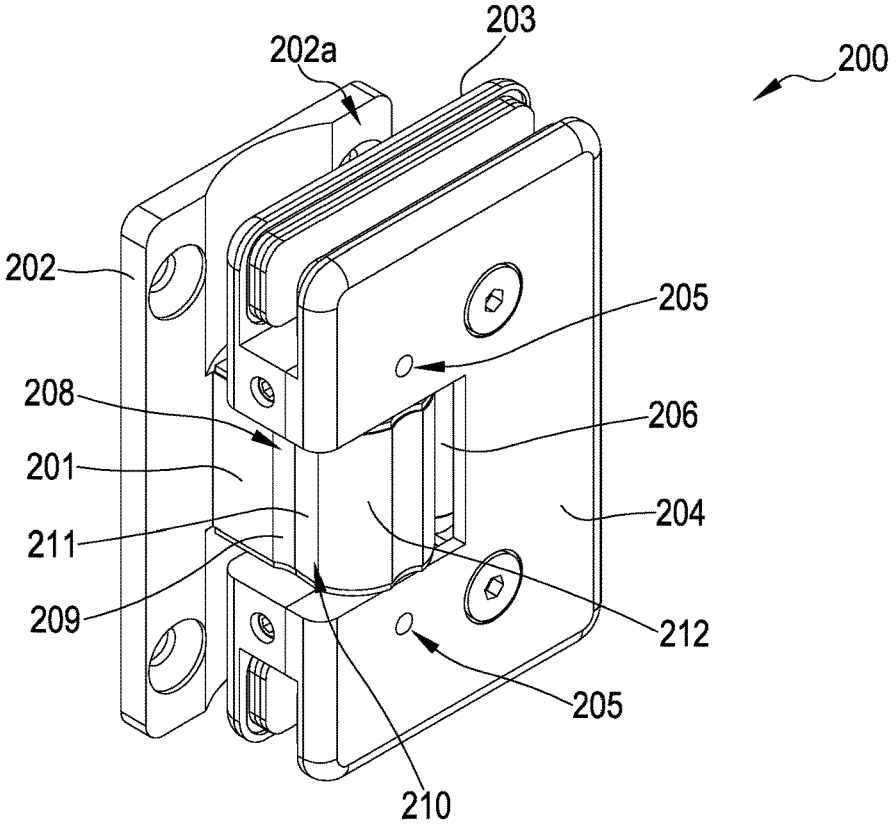
FIG. 30 is an assonometric view of the improved hinge of FIG. 29 in a possible operative position, corresponding to one of the second operative positions defined in the following in which the revolving shutter fully opens the room of the shower box.
Figure 31:
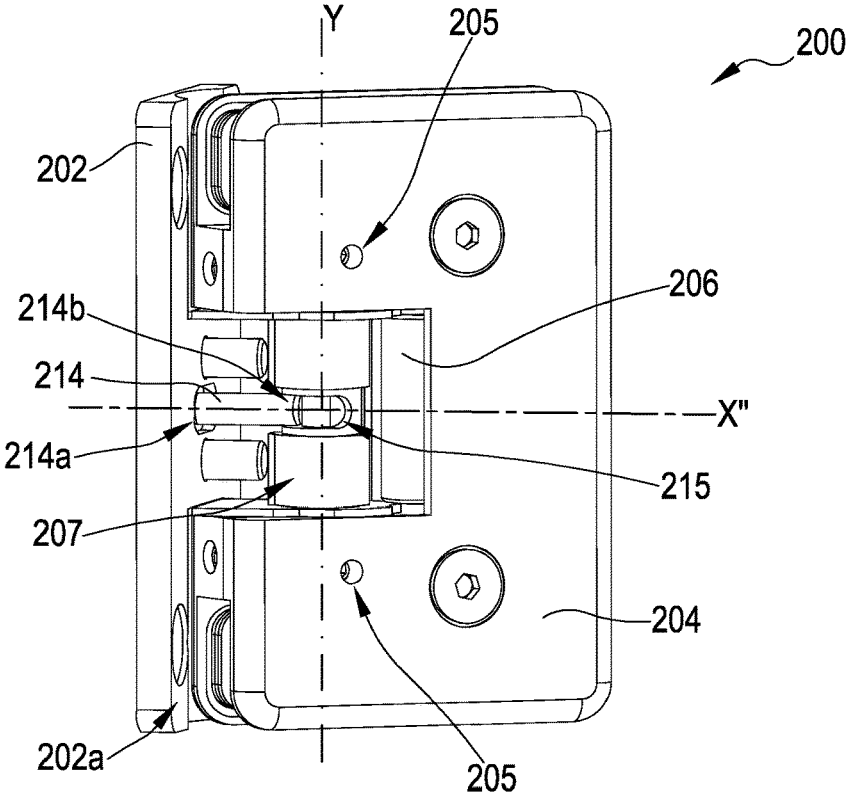
FIG. 31 is an assonometric view of the improved hinge of FIG. 29 in another operative position, corresponding to a generic intermediate position of the revolving shutter in which the latter partially opens the room of the shower box.

A second technical feature, already present in the improved hinges 1, 100 and 150 described above but then not highlighted, is related to the fact that the improved hinge 200 now concerned includes safety means, as a whole numbered with 213, suitable to cooperate with the operating shaft 207 in order to prevent the idle roller 206 comes out accidentally, harmful and improvident from each of the second grooves 209 when the revolving shutter A passes from the first operative position to the second operative position: the safety means 213 are better visible in the attached FIGS. 29-31.

Preferably but not necessarily, the safety means 213 comprise a cross stop pin 214, placed along a longitudinal direction X" orthogonal to the substantially vertical main axis Y of the operating shaft 207 and provided with a first end 214*a* suitable to be made integral with the fixed or bearing auxiliary structure (through the support plate 202) and with a second end 214*b*, opposite the first end 214*a*, which is free.

The safety means 213 also include a substantially semicircular slot 215 (shown in detail in FIG. 29) made in the cylindrical central body 207 of the operating shaft 216 and laterally delimited by curved walls which can be conjugated with the cross stop pin 214.

The second free end 214*b* of the cross stop pin 214 is always contained into the substantially semicircular slot 215 even during the rotation of the operating shaft 207 around the main axis Y, and contrasts with the curved walls of the substantially semicircular slot 215 itself when the revolving shutter A takes one of the two second operative positions, as it has been assumed to define them in the present invention.

The safety means 213 have the advantageous function of preventing that the rear part of the strike block 201 detrimentally enters into contact with the front wall 202*a* of the support plate 202 and rub (evidently, in a negative way, as it would cause scratches and/or similar, consequently impairing the aesthetic impact) against it during the movement of the revolving shutter A, if the latter, in order to be placed correctly in the first operative position of total closure of the shower room, has been adjusted by the adjustment means 205 so as to take a configuration of the type shown in the group of FIGS. 15-18 or in the group of FIGS. 19-22.

Figure 36:
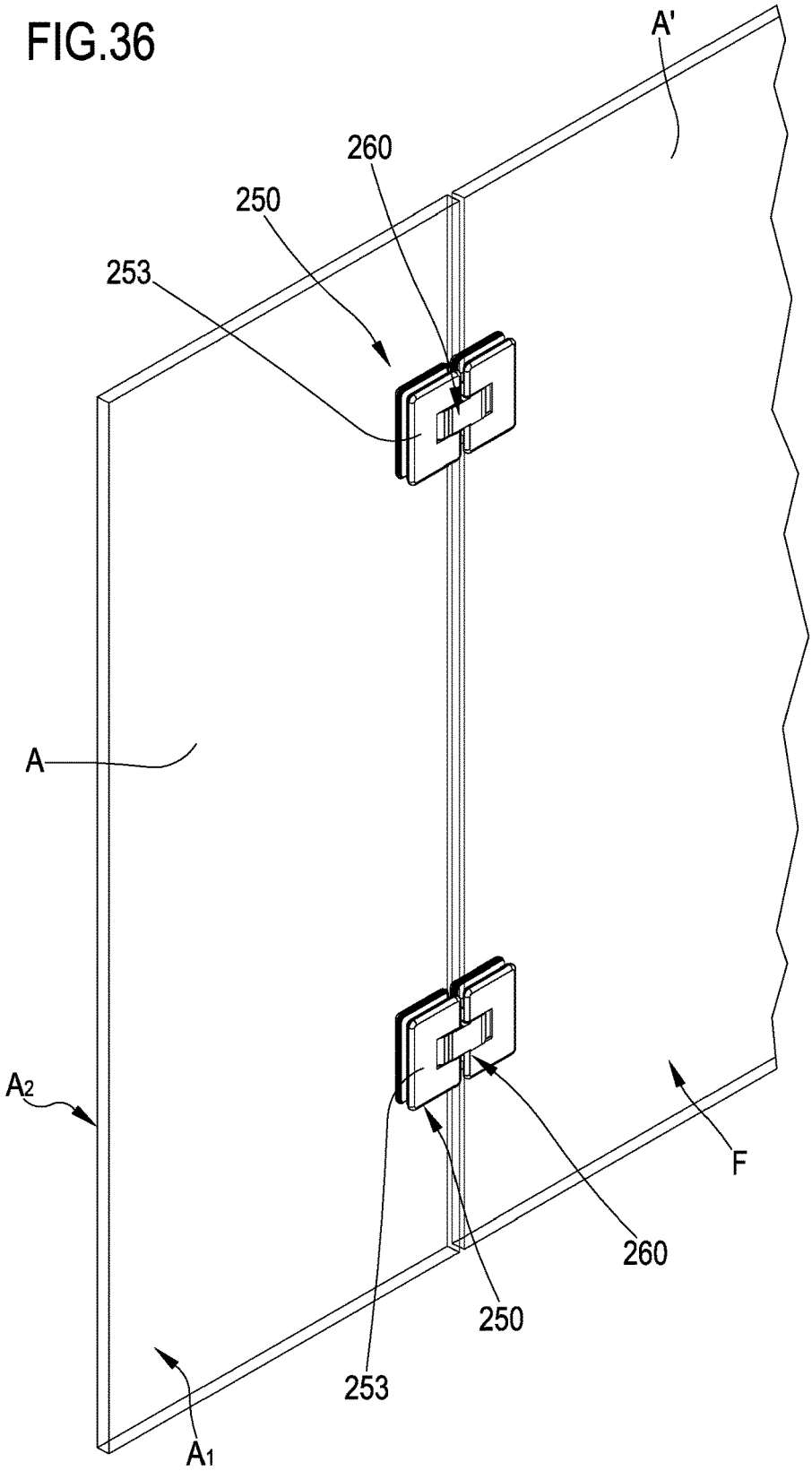
FIG. 36 is an assonometric view, in application conditions, of a fifth embodiment of the improved hinge of the invention, in this case of the so-called "180° glass-glass" type.

Subsequent FIG. 36 shows another possible invention embodiment, in which the improved hinge, now globally numbered with 250 and visible in two exemplars, differs from those ones previously described for the type of application being intended to connect each other in rotary manner two shutters, only one of which, indicated with A, actually revolving, while the other one, indicated with A', remains fixed and, together with an appropriate although known connection group overall indicated with 260, acts in this case as fixed or bearing auxiliary structure in place of the masonry wall of the versions of the improved hinge 1, 100, 150 and 200 already described above.

For this reason, the improved hinge 250 of the invention is notoriously and generally defined in the jargon of the technical field concerned as of the "glass-glass at 180°" type (in this case, purely by way of preferred, advantageous but not binding, example having possibility of adjustment through the adjustment means, indicated as a whole with 255).

Figure 37:
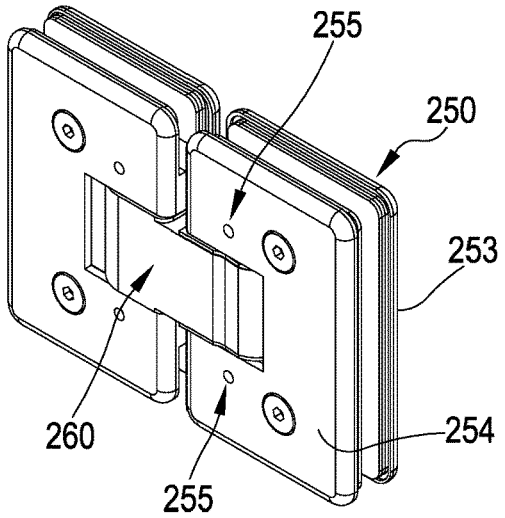
FIGS. 37-39 are three distinct assonometric views of the improved hinge of FIG. 36 in three distinct operative positions (corresponding in the order, to the first operative position defined in the following in which the revolving shutter closes the room of the shower box and to the two respective second operative positions defined in the following in which the revolving shutter totally opens such a room)
Figure 38:
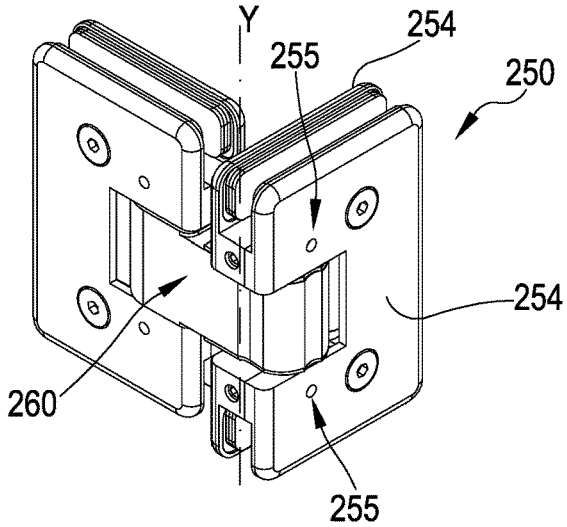
Figure 39:
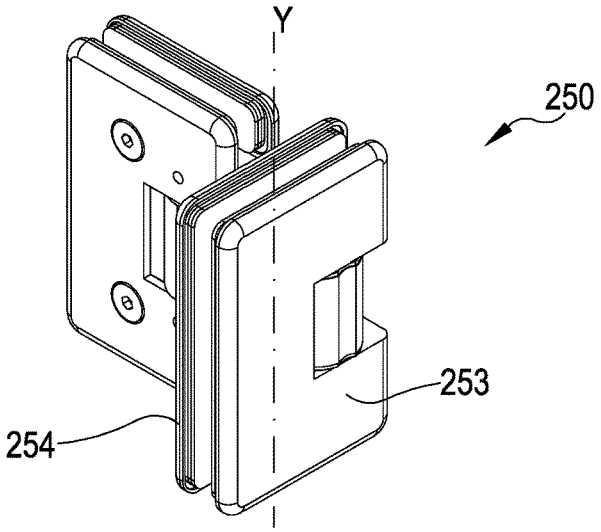

FIGS. 37-39 are exactly equivalent to FIGS. 3-5 mentioned above in relation to the improved hinge 1, as well as to FIGS. 25-27 in relation to the improved hinge 100, as it can be easily understood by observing the variation of the angular position of the shaped flanges 253, 254 in respect to the connection assembly 260 which the fixed shutter A' is coupled with. In particular, FIGS. 38 and 39 concretely and visually hint what already previously solely explained, i.e. as in the second operative position of the revolving shutter A, the plane defined by its side faces $A_1$, $A_2$, defines an angle of substantially 90° with the plane defined by the front face F of the fixed or bearing auxiliary structure A'.

Figure 40:
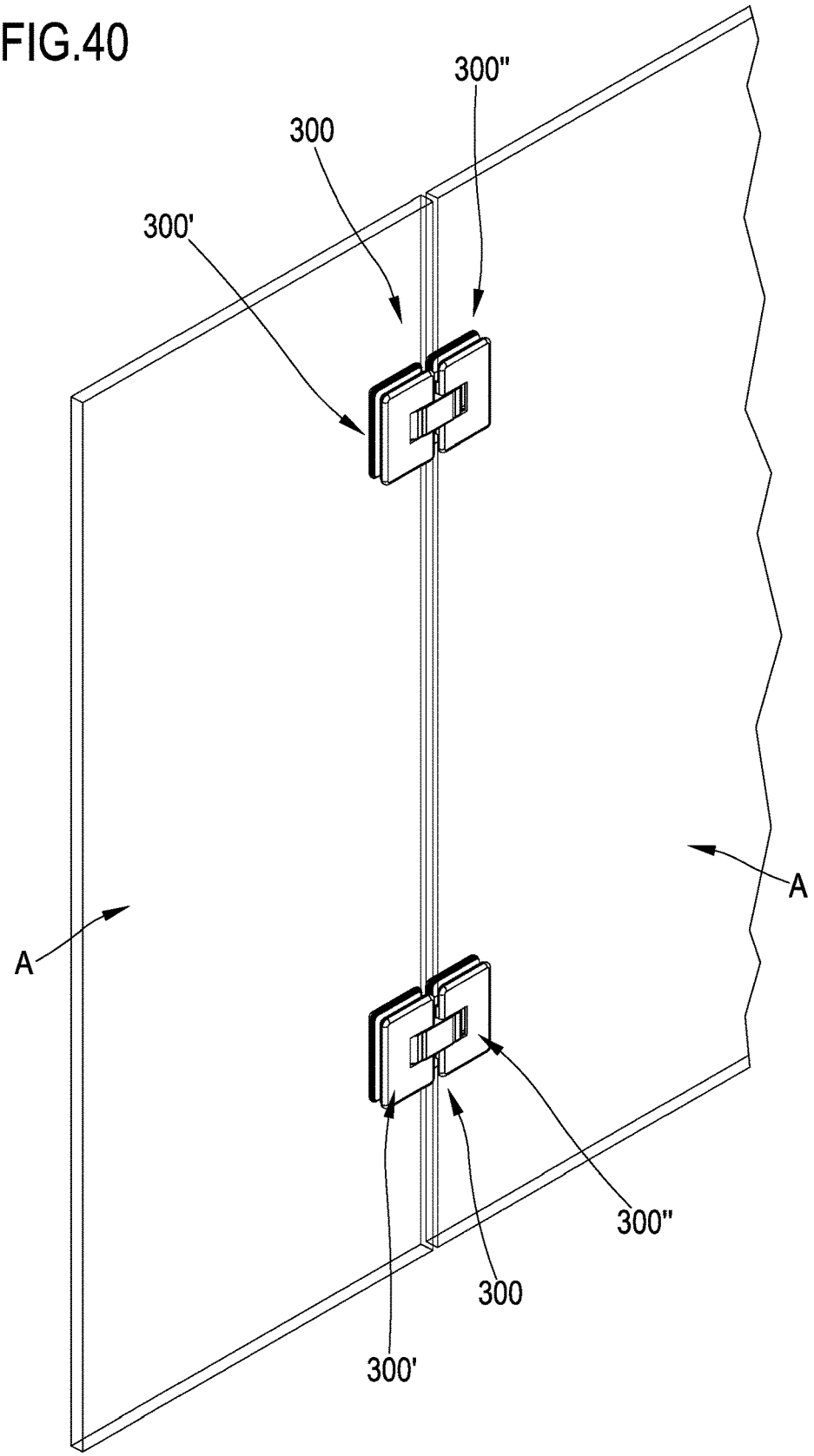
FIG. 40 is an assonometric view, in application conditions, of a sixth embodiment of the improved hinge of the invention, in this case of the so-called "360° glass-glass" type.

Likewise, the next FIG. 40 shows a further possible embodiment of the invention, in which the improved hinge, now globally numbered with 300 and still visible in two exemplars, differs from those ones described previously for the type of application being intended to mutually connect in rotating way two shutters A both revolving thanks to their specific connection.

In this case, indeed, the improved hinge 300 of the present invention is composite or double being, in essence, configured as a structural assembly which includes two improved hinges 300', 300" of the invention, connected each other through a gear mechanism, generically numbered with 310 and of the type known per se to the person skilled in the art.

Each of these improved hinges 300', 300" presents the essential and basic technical features indicated in the attached independent claim, and may be of the type already described and indicated with 1, 100, 150 or 200; in addition, each of the improved hinge 300', 300" serves as simply bearing (non-fixed) auxiliary structure in respect to the other.

For this reason, the improved hinge 300 of the invention is generally defined in the jargon of the technical field concerned as of the "360° glass-glass type" (also in this case, preferably but not necessarily, provided with adjustment through adjustment means, as a whole numbered with 305).

As explanatory principle, the FIGS. 41-43 follow exactly the same sequence of FIGS. 3-5 mentioned above in relation to the improved hinge 1, of FIGS. 25-27 in relation to the improved hinge 100 and of FIGS. 37-39 in relation to the improved hinge 250 yet described. On the basis of the description just given, it is understood, therefore, that the improved hinge for revolving shutters, especially though not exclusively of a shower box, object of the present invention, achieves the purposes and reaches the advantages previously mentioned. In general term, the improved hinge for revolving shutters of the invention can be applied to any type of door and is structured in such a way that when the revolving shutter takes what in the present description and in the appended claims is defined as the first operative position—in which it fully closes the room of the shower box, or of any environment, the fastening means which stably connect the shaped flanges each other are not in any way visible from the outside, to all advantage of the pleasantness of the aesthetic impact offered by the improved hinge of the invention which thus positively contributes to the more general and significant given by the revolving shutter which is coupled with.

Upon execution stage, changes could be made to the improved hinge for revolving shutters, especially of shower boxes, of the current invention, consisting, for example, in fastening means, which firmly connect each other the two shaped flanges, different in concept and positioning with respect compared to those ones previously described.

In addition, further embodiments of the improved hinge for revolving shutter claimed herein, not illustrated, could provide that the side groove communicating with the outside, defined by the union of the two shaped flanges, develops for a part of the perimeter of each of the shaped flanges themselves different from that one which can be obtained by the figures that follow, which does not affect the advantage brought by the present invention.

In particular, in other embodiments of the improved hinge of the invention, yet not shown, at least one of the shaped flanges (in particular that one having through holes useful for the stable mutual coupling of the shaped flanges themselves through the fastening means), as well as the support plate fixed to the fixed or bearing auxiliary structure, could be advantageously provided with a finishing element in view which, stably but removably applied to the outer face of these components of the improved hinge, covers its discontinuity zones (such as just the through holes) which otherwise remain in sight, improving the overall aesthetic effect of the innovative finished product herein proposed by the applicant. It is, finally, clear that several other changes could be made to the Improved hinge for revolving shutters concerned, without departing from the principle of novelty intrinsic in the inventive idea expressed herein, as it is clear that, in the practical implementation of the invention, materials, shapes and sizes of the illustrated details could be changed, as needed, and replaced with others technically equivalent.

Where the constructive features and techniques mentioned in the following claims are followed by reference numbers or signs, those reference signs have been introduced with the sole objective of increasing the intelligibility of the claims themselves and therefore they have no limiting effect on the interpretation of each element identified, by way of example only, by these reference signs.

The invention claimed is:

1. Improved hinge for revolving shutters A, especially of shower boxes, comprising a structural assembly which includes:

a strike block defining a substantially vertical main axis Y and suitable to be made integral with a fixed or bearing auxiliary structure A' a pair of shaped flanges opposite, facing and coupled each other through fastening means in such a way as to define at least:

a side recess in which said strike block is substantially housed;

a side groove which communicates with the outside and develops for at least part of the perimeter of each of said shaped flanges and is suitable to receive a peripheral portion of a revolving shutter A of a shower box;

an inner seat hidden from view in which rotation means are stably housed defining an auxiliary axis Y' parallel to said main axis Y of said strike block and cooperating, on one side, with said strike block in such a way as to define a first operative position, in which said revolving shutter A closes totally, remaining stable in position, a room of said shower box, and at least one second operative position, in which said rotating shutter A, as a result of rotation around said main axis Y imparted by a user, opens fully, remaining stable in position, said room of said shower box, and, on the other side, with elastic means suitable to retain said rotation means stably against said strike block at each of said operative positions, characterized in that said elastic means comprise an elastically yielding laminar body shaped in such a way as to substantially embed in its own overall encumbrance said rotation means that include a single idle roller which extends for the entire height H, defined parallel to said main axis Y, of a head portion of said strike block, opposite to a base portion associated with said fixed or bearing auxiliary structure A'.

2. Hinge according to claim 1, characterized in that said laminar body presents in side view a profile in the shape of C or U or similar.

3. Hinge according to claim 1, characterized in that said laminar body and said idle roller are stably kept by precision into said inner seat by means of the structural connection of said shaped flanges determined by said fastening means.

4. Hinge according to claim 1, characterized in that said idle roller is fixed to said laminar body by means of constraint means.

5. Hinge according to claim 4, characterized in that said constraint means comprise a pair of side pins, projecting axially from opposite sides from said idle roller, and a pair of concave open-profiled recesses, made in a pair of side flaps opposite each other protruding from a main central portion of said laminar body, said side pins being received into said open-profiled recesses where they are stably kept through coupling means.

6. Hinge according to claim 1, characterized in that said inner seat is defined at least by:

said strike block inserted into said side recess;

a pair of shaped baffles opposite each other, arranged on the inner face of a first of said shaped flanges symmetrically with respect to a first symmetry axis X defined by said first shaped flange orthogonally to said main axis X and to said auxiliary axis Y'.

7. Hinge according to claim 6, characterized in that said inner seat is defined by a pair of shaped projections, having the same profile of said shaped baffles to which are respectively facing and juxtaposed, arranged on the inner face of a second of said shaped flanges symmetrically with respect to a second symmetry axis X' coincident with said first symmetry axis X and belonging to said second shaped flange.

8. Hinge according to claim 6, characterized in that said strike block comprises angular end-of-stroke means positioned on its outer surface and which said idle roller cooperates with in order to define for said revolving shutter A said first operating position and said second operating position.

9. Hinge according to claim 8, characterized in that said angular end-of-stroke means comprise:

a first concave surface groove made in said head portion of said strike block;

a second concave groove surface made in at least one of the two side walls, interposed between said head portion and said base portion, of said strike block, said idle roller snap engaging and being partly contained into said first concave surface groove, when said revolving shutter A takes said first operative position, and into said second concave surface groove when said revolving shutter A takes said second operating position.

10. Hinge according to claim 9, characterized in that said concave surface grooves extend in said strike block for said entire height H which is substantially equal to the length L of said idle roller.

11. Hinge according to claim 9, characterized in that said first groove is separated from said second groove by a convex surface stretch belonging to said head portion of said strike block, in such a way as to confer to said head portion substantially the shape of cap and so that said idle roller, when it is in the position in which it is inserted into said second groove, is offset substantially of 90° with respect to the position in which it is when it is inserted into said first groove.

12. Hinge according to claim 11, characterized in that it said second concave surface groove comprises guide means suitable to turn away said revolving shutter A from said first operative position up to keep it, when it takes said second operative position, in a position such that the plane defined by its side faces $A_1$, $A_2$ is always, in any applicative condition, positioned parallel to the plane defined by the front face F of said fixed or bearing auxiliary structure A'.

13. Hinge according to claim 12, characterized in that said guide means comprise a tapered flat wall belonging to said second surface groove and linearly converging from the end part of said convex surface stretch towards a first symmetry axis X defined by said first shaped flange up to a concave end portion of said second surface groove.

14. Hinge according to claim 9, characterized in that said strike block is provided with an operating shaft that defines said main axis Y, around which said revolving shutter A rotates in order to position alternately between said operative positions, and is inserted into a through axial opening made in said strike block and into at least one through axial hole, coaxial to said through axial opening and defined by the union of said shaped flanges.

15. Hinge according to claim 14, characterized in that said through axial hole is defined between at least one support tooth and one of said shaped baffles of said first shaped flange and between at least one relief rib and one of shaped projections of said second shaped flange.

16. Hinge according to claim 15, characterized in that said operating shaft includes:

a cylindrical central body, housed in the intermediate zone, included in said side recess, of said through axial opening of said strike block;

at least one edged end portion, projecting axially from said cylindrical central body and housed into said through axial hole.

17. Hinge according to claim 16, characterized in that it includes safety means suitable to cooperate with said operating shaft in order to prevent said idle roller comes out accidentally from said second groove during the passage of said revolving shutter A from said first operative position to said second operative position.

18. Hinge according to claim 17, characterized in that said safety means comprise:

a cross stop pin, positioned along a longitudinal direction X" orthogonal to said substantially vertical main axis Y of said operating shaft and provided with a first end suitable to be made integral with said fixed or bearing auxiliary structure A' and with a second end, opposite to said first end, that is free;

a substantially semicircular slot made in said cylindrical central body (50; 216) of said operating shaft and delimited laterally by curved walls which can be conjugated with said cross stop pin;

said second free end of said cross stop pin being always contained into said substantially semicircular slot even during the rotation of said operating shaft around said main axis Y.

19. Hinge according to claim 16, characterized in that it comprises adjustment means, associated with said operating shaft and accessible through a handling tool, actuated by the operator, and through at least one auxiliary through hole made in one of said shaped flanges, suitable to allow to correctly position said revolving shutter A in said first operative position, according to the installation needs and/or constraints, allowing its rotation around said main axis Y and around at least a secondary axis Z transverse to said main axis Y.

20. Hinge according to claim 19, characterized in that said adjustment means comprise a grain which can be actuated in rotation by the operator by means of said handling tool and inserted into a threaded transverse hole made in said edged end portion along said secondary axis Z perpendicular to said main axis Y, to said auxiliary axis Y' and said first symmetry axis X.

21. Hinge according to claim 20, characterized in that it includes locking means associated with said operating shaft, suitable to be actuated by the operator to stably lock said adjustment means in the position in which said revolving shutter A correctly takes said first operative position of total closure of said room of said shower box.

22. Hinge according to claim 14, characterized in that said strike block is provided with at least one self-lubricating bushing, placed adjacent to at least an axial portion of the inner wall defining said through axial opening in such a way as to limit the friction of said operating shaft when, by rotating around said main axis Y, cooperates by contact with said self-lubricating bushing which is kept in position by a folded safety washer disposed close to a side edge of said strike block and associated with one end of said self-lubricating bushing.

23. Hinge according to claim 1, characterized in that said shaped flanges comprise centering means suitable to ease their correct mutual alignment before the final application of said fastening means with which are made integral each other.

24. Hinge according to claim 23, characterized in that said centering means comprise:

at least one reference mark projecting from a support tooth arranged on the inner face of a first of said shaped flanges;

at least one blind hole, coaxial with said reference mark, made in a relief rib arranged on the inner face of a second of said shaped flanges and having the same profile of said support tooth, said reference mark engaging inside said blind hole.

* * * * *